US011359374B2

(12) United States Patent
Callahan

(10) Patent No.: US 11,359,374 B2
(45) Date of Patent: Jun. 14, 2022

(54) LEG-CARRIAGE TYPE TRUSSES

(71) Applicant: Michael Callahan, New York, NY (US)

(72) Inventor: Michael Callahan, New York, NY (US)

( * ) Notice: Subject to any disclaimer, the term of this patent is extended or adjusted under 35 U.S.C. 154(b) by 0 days.

(21) Appl. No.: 17/181,179

(22) Filed: Feb. 22, 2021

(65) Prior Publication Data

US 2021/0262231 A1 Aug. 26, 2021

Related U.S. Application Data

(60) Provisional application No. 62/979,762, filed on Feb. 21, 2020.

(51) Int. Cl.
*E04C 3/02* (2006.01)
*E04B 1/343* (2006.01)

(52) U.S. Cl.
CPC ..... *E04C 3/02* (2013.01); *E04B 1/34352* (2013.01)

(58) Field of Classification Search
CPC ..... E04C 3/02; E04C 3/08; E04C 2003/0491; E04B 1/34352
USPC ..... 52/223.8
See application file for complete search history.

(56) References Cited

U.S. PATENT DOCUMENTS 2,711,180 A * 6/1955 Sims ..... E04B 1/34326 135/160
2,790,524 A * 4/1957 Herrschaft ..... A47B 57/565 52/843
3,077,009 A * 2/1963 Hutchinson ..... E04C 3/02 52/632
3,562,994 A * 2/1971 Von Linsowe ..... E04C 3/08 52/650.2
3,604,166 A * 9/1971 Ciccarelli ..... E04B 1/34331 52/79.5
4,269,384 A * 5/1981 Saeed ..... E01D 19/00 248/548
4,644,628 A * 2/1987 Coppa ..... E04C 3/02 29/429

(Continued)

FOREIGN PATENT DOCUMENTS

DE 362627 C * 4/1921 ..... A63J 1/00

*Primary Examiner* — Brian D Mattei
*Assistant Examiner* — Joseph J. Sadlon
(74) *Attorney, Agent, or Firm* — Davidson, Davidson & Kappel, LLC

(57) ABSTRACT

The disclosure relates to "leg carriage" type trusses, which rely for shipping on elevation by a pair of U-shaped wheeled temporary supports, each having two legs connected by a low horizontal member. The upper ends of the legs are inserted in receiving sleeves installed in the four corners of the truss structure. The clearance between the outer dimensions of the leg and the inner dimensions of the sleeve impact the ease with which legs can be inserted and removed, as well as the lateral "play" in the connection between the leg and truss, which impacts its stability in handling and therefore safety. The disclosure addresses the previous conflict between the two objects by the use of asymmetrical clearances. A relatively relaxed tolerance in the elongated axis of the truss eases insertion and removal. A lesser relative tolerance across the axis of the truss width has no significant impact on leg insertion and removal yet improves stability.

15 Claims, 52 Drawing Sheets

(56) References Cited

U.S. PATENT DOCUMENTS 5,307,598 A * 5/1994 West ..... E01F 9/642 232/39
5,333,420 A * 8/1994 Eden ..... B60P 3/34 52/64
5,335,468 A * 8/1994 Oberman ..... A63J 1/02 52/645
5,390,463 A * 2/1995 Sollner ..... E04C 3/08 403/14
5,429,417 A * 7/1995 Kim ..... A47B 47/005 403/197
6,332,298 B1 * 12/2001 Bigelow ..... E04B 7/08 52/236.7
6,658,798 B1 * 12/2003 Frerichs ..... B60P 3/34 296/171
6,682,253 B2 * 1/2004 Binna ..... F16L 3/00 403/263
7,197,856 B2 * 4/2007 Coles ..... E04C 3/005 52/638
8,142,047 B2 * 3/2012 Acampora ..... F21V 15/01 362/217.01
8,671,627 B2 * 3/2014 Marshall ..... E02D 27/32 52/125.1
8,905,274 B2 * 12/2014 Sibiet ..... B22D 41/50 266/236
9,115,504 B2 * 8/2015 Wallance ..... E04B 1/34331
9,382,714 B2 * 7/2016 Richardson ..... E04C 3/02
9,850,654 B2 * 12/2017 Shalev ..... E04B 1/3431
10,267,056 B1 * 4/2019 Eastland ..... E04H 15/48
10,344,494 B2 * 7/2019 Volin ..... E04H 6/04
10,626,611 B2 * 4/2020 Thrall ..... E04B 1/40
10,760,263 B2 * 9/2020 Hossler ..... E04C 3/02
2004/0187426 A1 * 9/2004 Callahan ..... E04C 3/08 52/653.1
2006/0096228 A1 * 5/2006 Chen ..... F16B 12/40 52/633

* cited by examiner

Prior Art

Prior Art

Prior Art

Prior Art

Fig.2DD
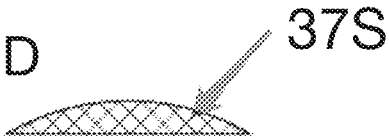
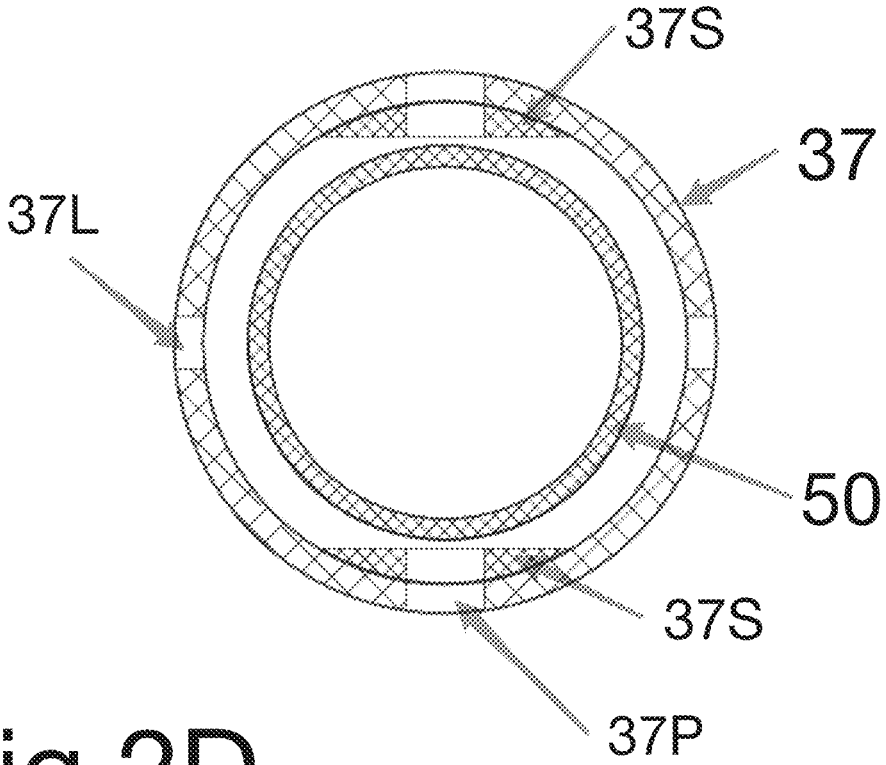
Fig.2D

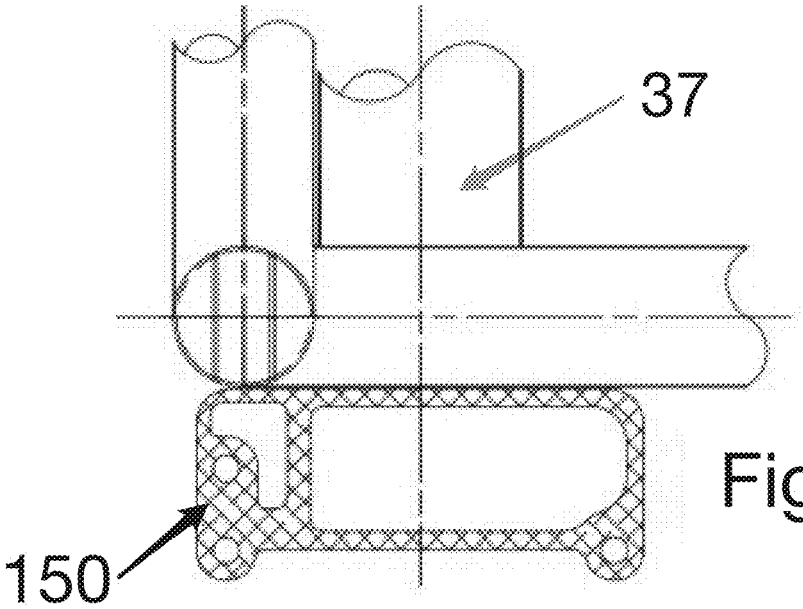
Fig.5A
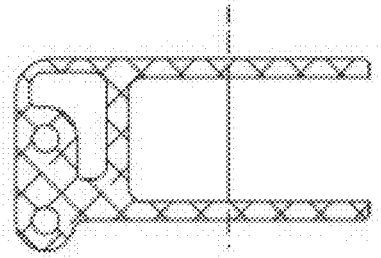
Fig.5B
Fig.5C
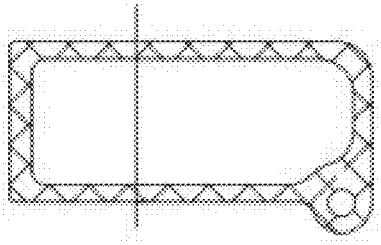

Fig.6A
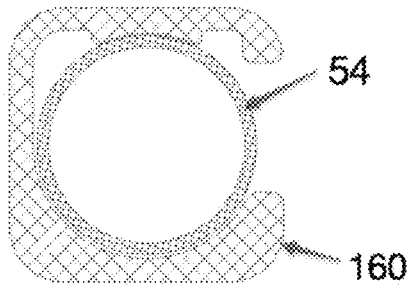
Fig.6B
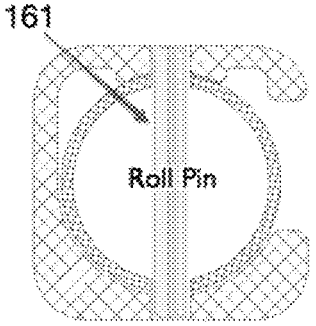
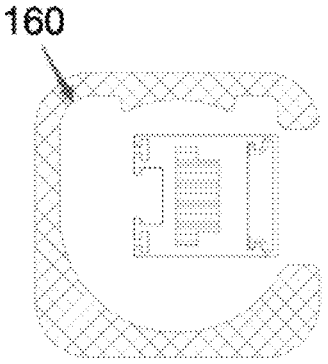
Fig.6C
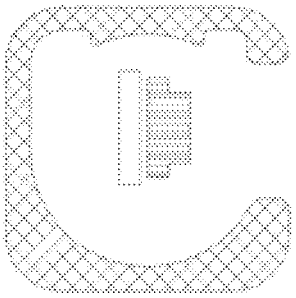
Fig.6D
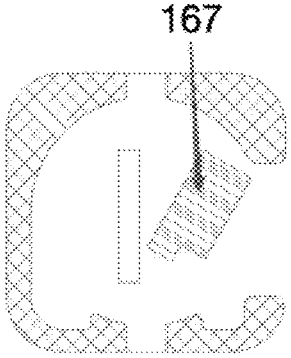
Fig.6E Fig.6G
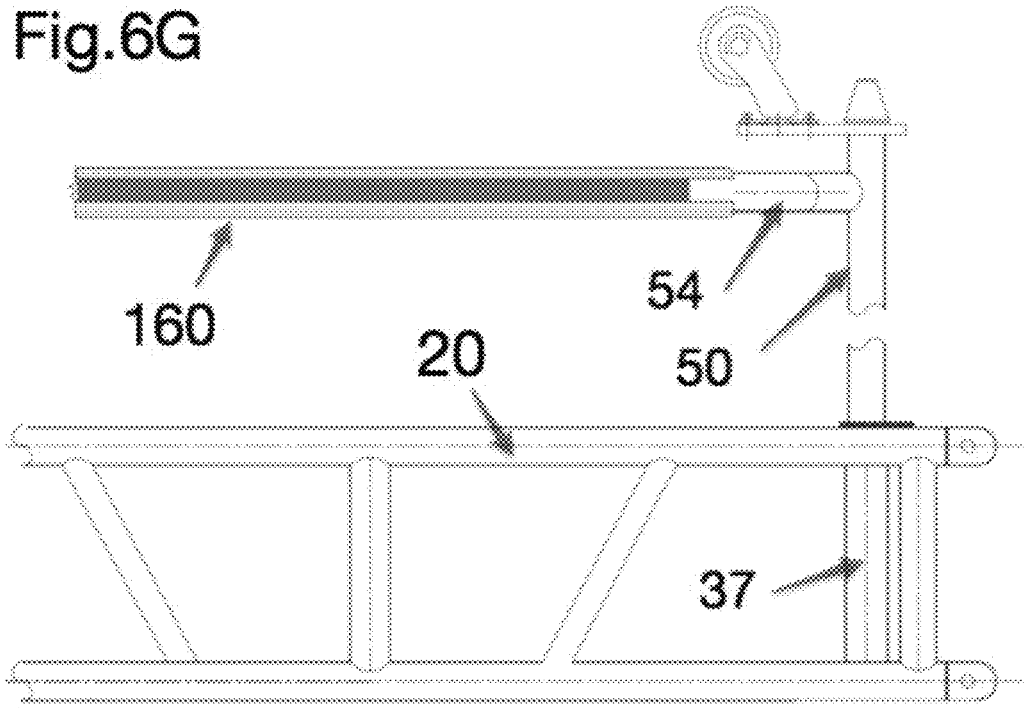
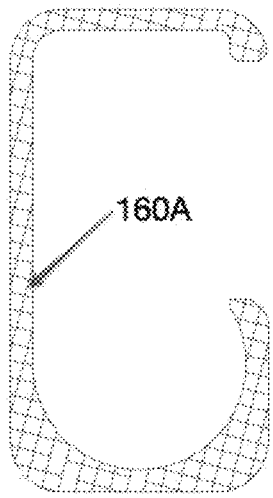
Fig.6H
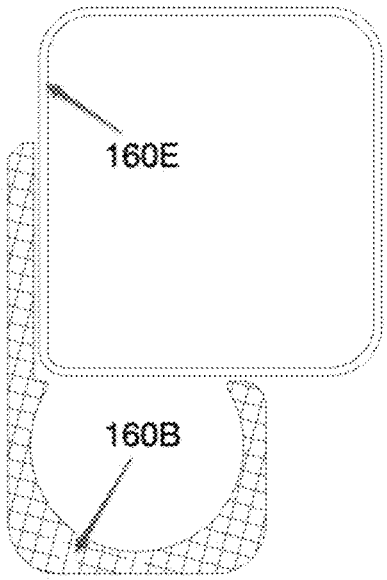
Fig.6I Prior Art Fig.6K
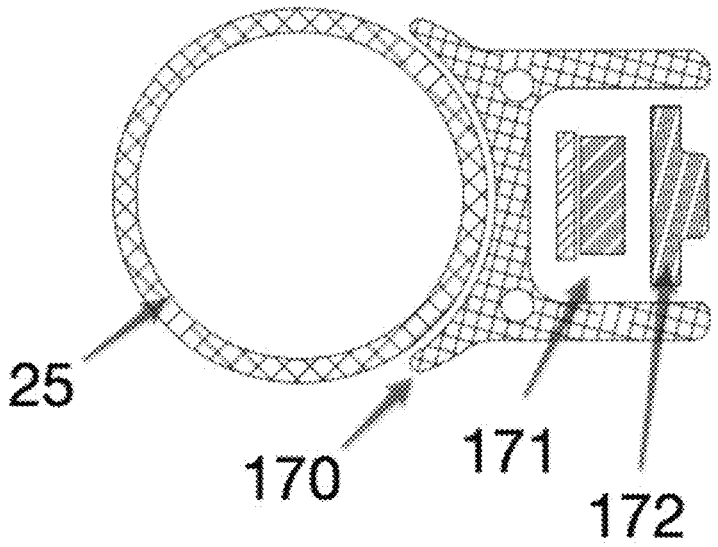
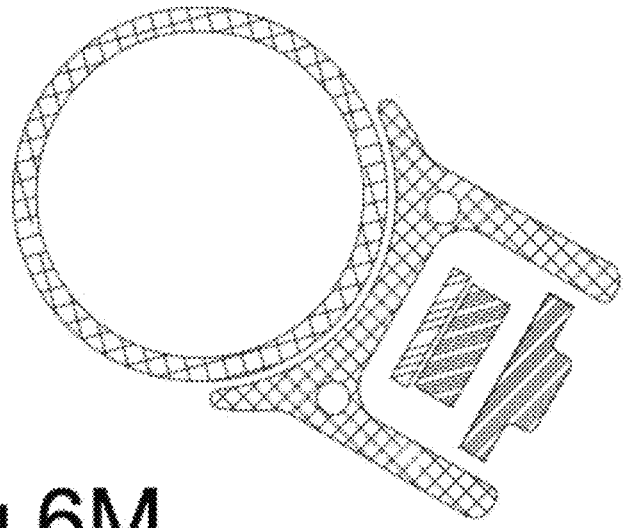
Fig.6M Fig.7C
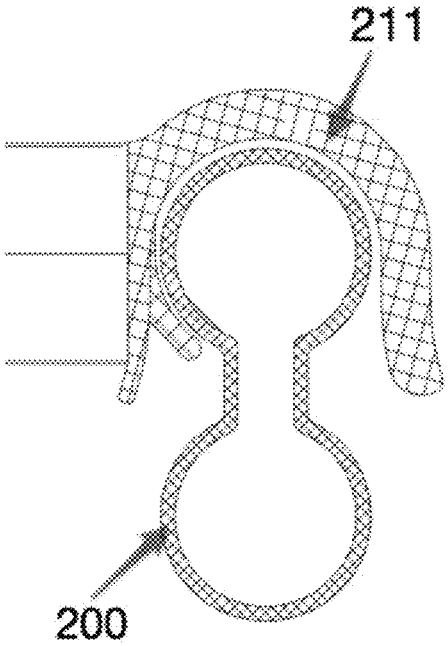
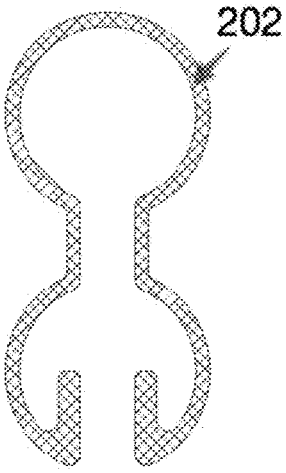
Fig.7D
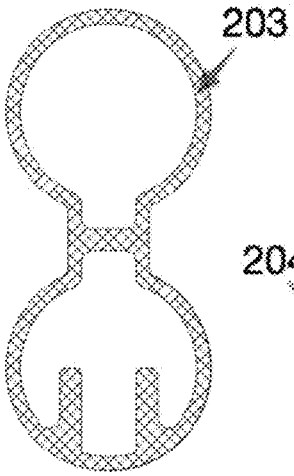
Fig.7E
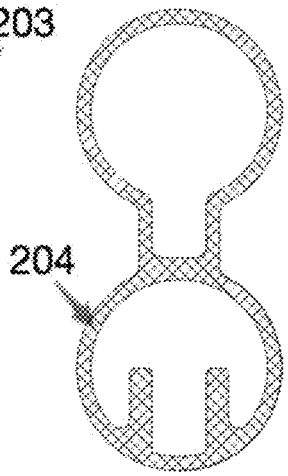
Fig.7F Fig.7I
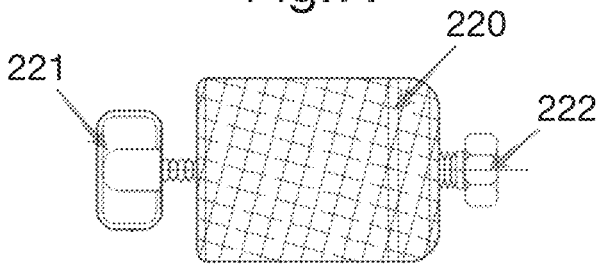
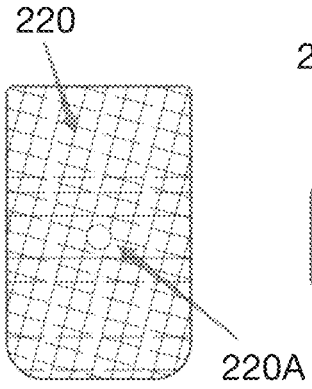
Fig.7J
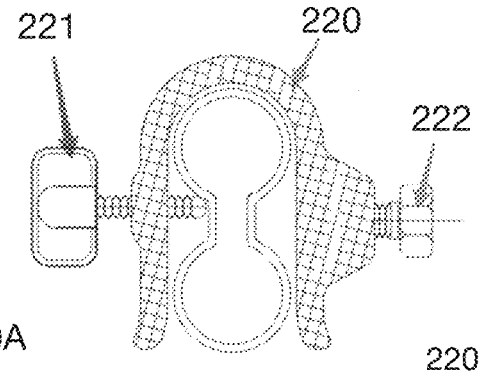
Fig.7K
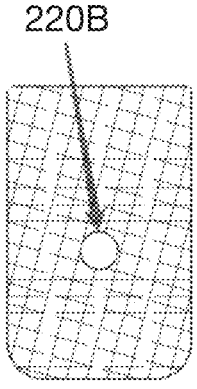
Fig.7L Fig.7P
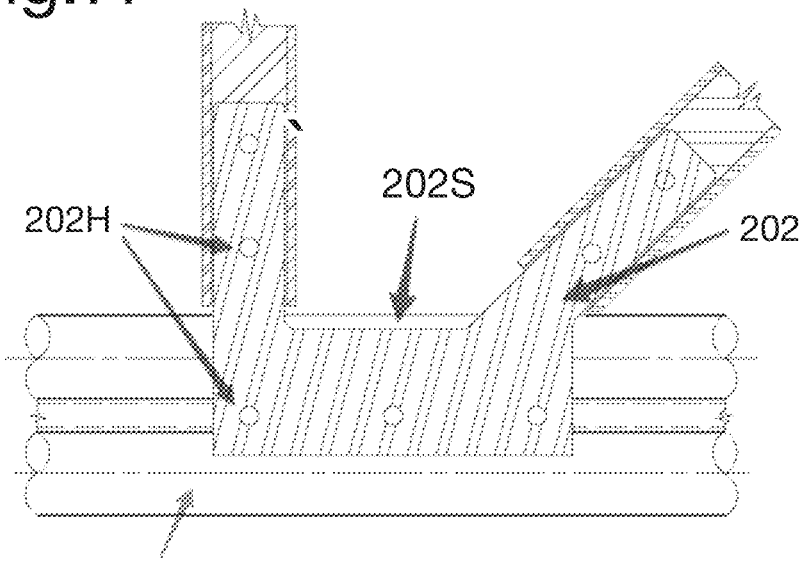
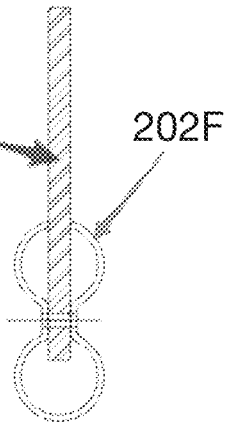
Fig.7Q Fig.8C
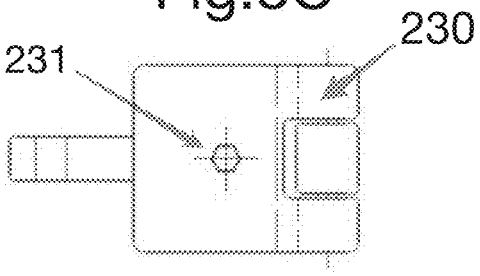
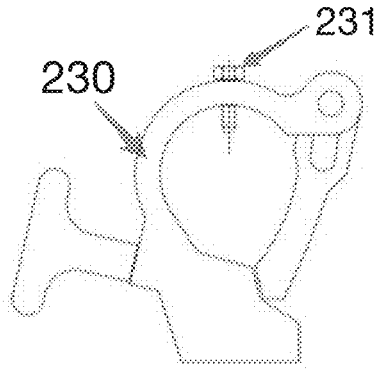
Fig.8D
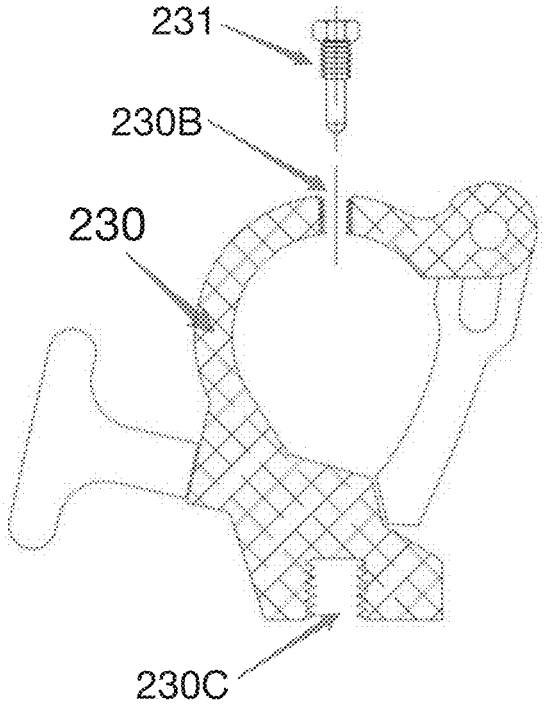
Fig.8E Fig.8F
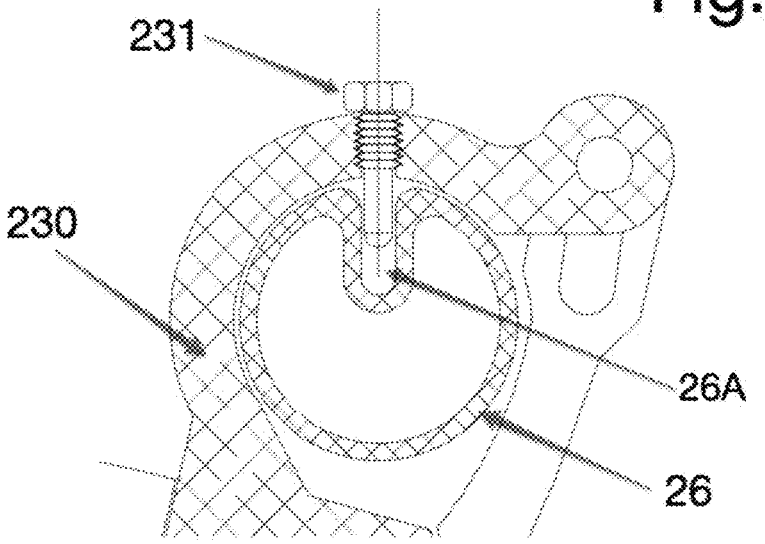
Fig.8G
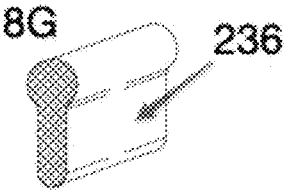
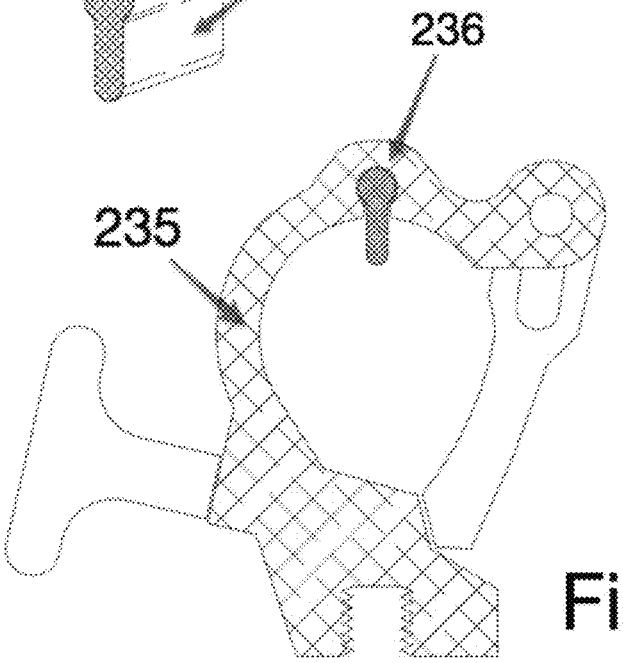
Fig.8H Prior Art

D

LEG-CARRIAGE TYPE TRUSSES

This application claims priority to U.S. Provisional Application Ser. No. 62/979,762, filed Feb. 21, 2020, the entire disclosure of which is hereby incorporated by reference.

This application is related to: U.S. Provisional Application Ser. No. 61/973,592, filed Apr. 1, 2014, U.S. application Ser. No. 14/676,616, filed Apr. 1, 2015, U.S. application Ser. No. 15/614,902, filed Jun. 6, 2017, U.S. application Ser. No. 15/945,987, filed Apr. 5, 2018, U.S. Provisional Application Ser. No. 62/743,095, filed Oct. 9, 2018, U.S. application Ser. No. 16/253,620, filed Jan. 22, 2019, and U.S. application Ser. No. 16/596,002, filed Oct. 9, 2019, the entire disclosures of which are hereby incorporated by reference.

This application relates to truss structures, such as are used in entertainment and event production.

BACKGROUND OF THE INVENTION

Many kinds of entertainment and event production require the support of technical elements overhead, such as scenery, drapes, lighting, sound, projection screens and video walls, as well as their associated cabling. Purpose-built facilities like theaters and opera houses often have moveable pipes or "battens" suspended over their stages, as well as fixed mounting positions in the auditorium. Film and television studios have a pipe "grid" or catwalk system installed overhead.

To offer or enhance entertainment and events in venues without such provisions (e.g., gymnasiums, sports arenas, and convention centers) lightweight portable truss structures were developed in the early 1970s, and have since been in continuous international production and use.

For one type of such structure the loads supported, such as light fixtures, are transported off the truss and attached at the venue, requiring much time and effort. When the goal is to repeat the same production in a succession of different venues, such as on tour, attaching loads at each venue and then removing them again before shipping is very wasteful. As such, since 1972, "pre-rig" truss designs have been offered which permit shipping truss sections with loads still attached.

In the 1980s, "automated" fixtures (as disclosed in U.S. Pat. No. 3,845,351 to von Ballmoos et al) came into increasing use. A "pre-rig" truss adapted to their special needs was desirable not only for efficiency, but because these far more complex fixtures are subject to wear and damage from handling.

A suitable approach is "re-configuration", in which the truss structure itself is hinged to an intermediate fixture support, and fixtures are changed from a fully enclosed shipping position to an external use position by "re-folding" the truss around them. U.S. Pat. No. 4,862,336 to Richardson et al is an early example. Such structures were, however, mechanically more complex and, therefore, expensive and they required time and labor to reconfigure on site.

Another approach, "elevated in transit", has since become the norm. In it, the truss structure is rigid but limited in height, such that the fixtures are permanently exposed and their beams adjustable across a wide angular range. During shipping, temporary wheeled supports keep the truss and fixtures elevated.

One class of such trusses, disclosed in U.S. Pat. No. 8,517,397 to Gross and U.S. patent application Ser. No. 13/247,501 to Christie et al, lands the truss section atop a wheeled structure, which itself is folded for storage while the truss is in use.

Another class of such trusses, disclosed in U.S. Pat. No. 8,099,913 to Dodd, attaches a pair of U-shaped wheel supports ("leg carriages") to the truss while it is still suspended. Introduced in 2008 as the "HUD" or "GT" truss, as manufactured by Tyler Truss Systems of Pendleton, Ind. 46064, it has come to be widely accepted. This "leg carriage" approach, subsequently also seen from other builders has had, however, a number of long-known problems.

As disclosed in prior related applications and in greater detail in the Detailed Description, these include difficulties in attaching and removing leg carriages and in efficient off-truss storage of them.

In one aspect, a conflict has existed between ease of leg insertion and removal versus undesirable lateral "play" in the connection between leg carriages and the truss which reduces the stability of the truss and can lead to tip-over of sections, especially when double-stacked.

Other issues in the design of prior art "leg carriage" and other truss types and related products will be described.

SUMMARY OF THE INVENTION

In one aspect of the disclosure, the long-standing problems with leg insertion and removal and lateral stability are addressed by the use of shapes for a carriage leg and for the leg-receiving sleeve in the truss which provide different clearances in the elongated axis of the leg carriage and truss, versus the axis across the width of the truss. A relatively relaxed tolerance in the elongated axis allows for variations in the relative motions of the two workers required to insert or remove a leg carriage, one at each end. A reduced relative tolerance across the axis of the truss width has no significant impact on leg insertion and removal, but reduces undesirable "play" in the leg/truss connection, improving stability.

Other disclosures address other issues in the design of prior art "leg carriage" and other truss types and related products.

A BRIEF DESCRIPTION OF THE DRAWINGS

FIG. 2DD is a section through an example additional part.

Figure 2A:
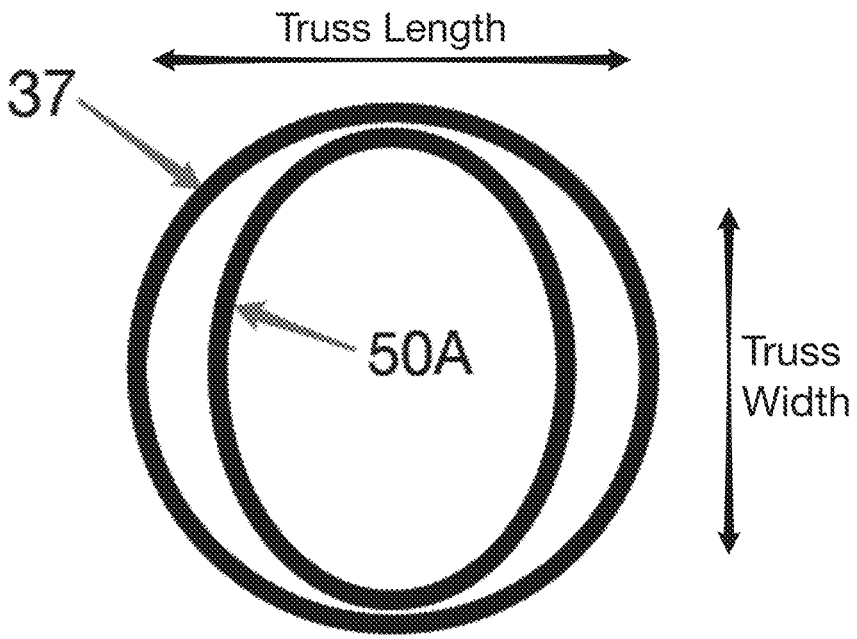
FIG. 2A is a section through a leg and sleeve showing asymmetrical clearances as produced by an ovoid leg.
Figure 2B:
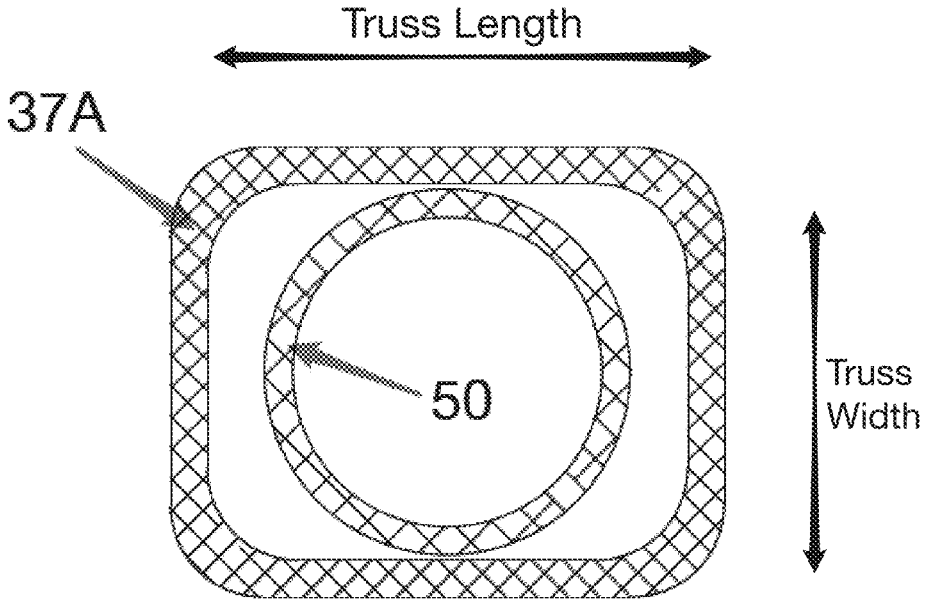
FIG. 2B is a section through a leg and sleeve showing asymmetrical clearances as produced by an elongated sleeve.
Figure 2C:
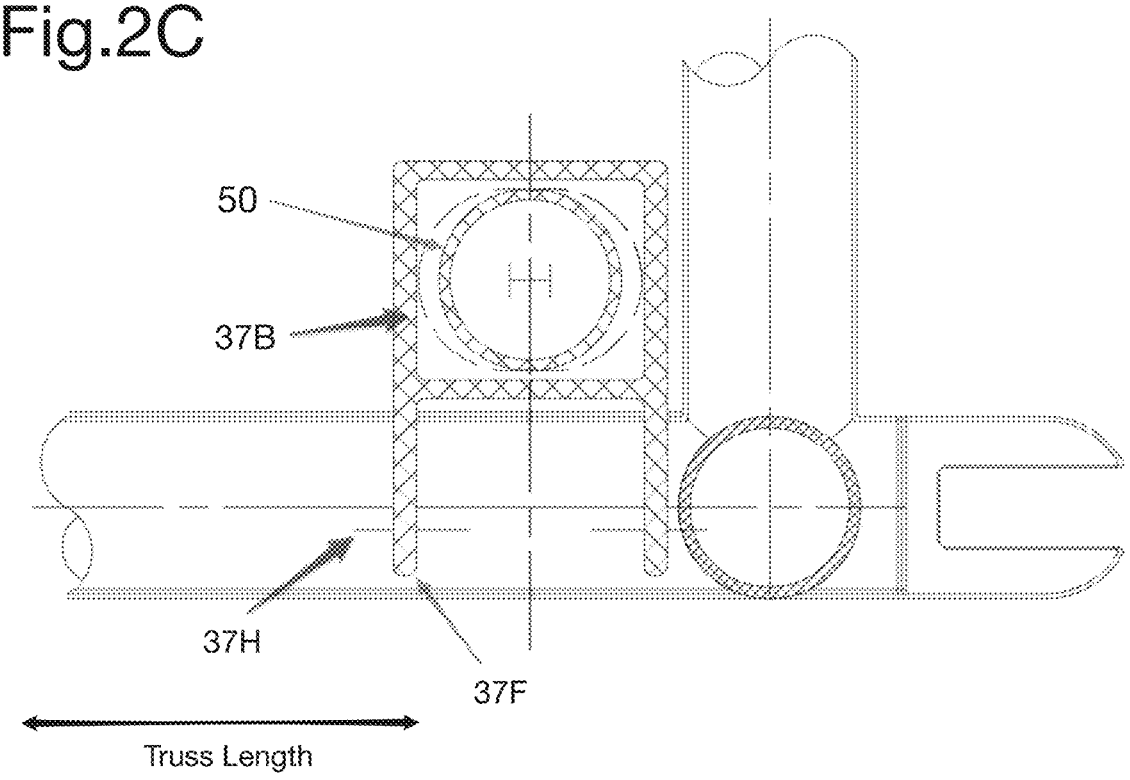
FIG. 2C is a section through a leg and sleeve showing asymmetrical clearances as installed in a truss section.
Figure 2E:
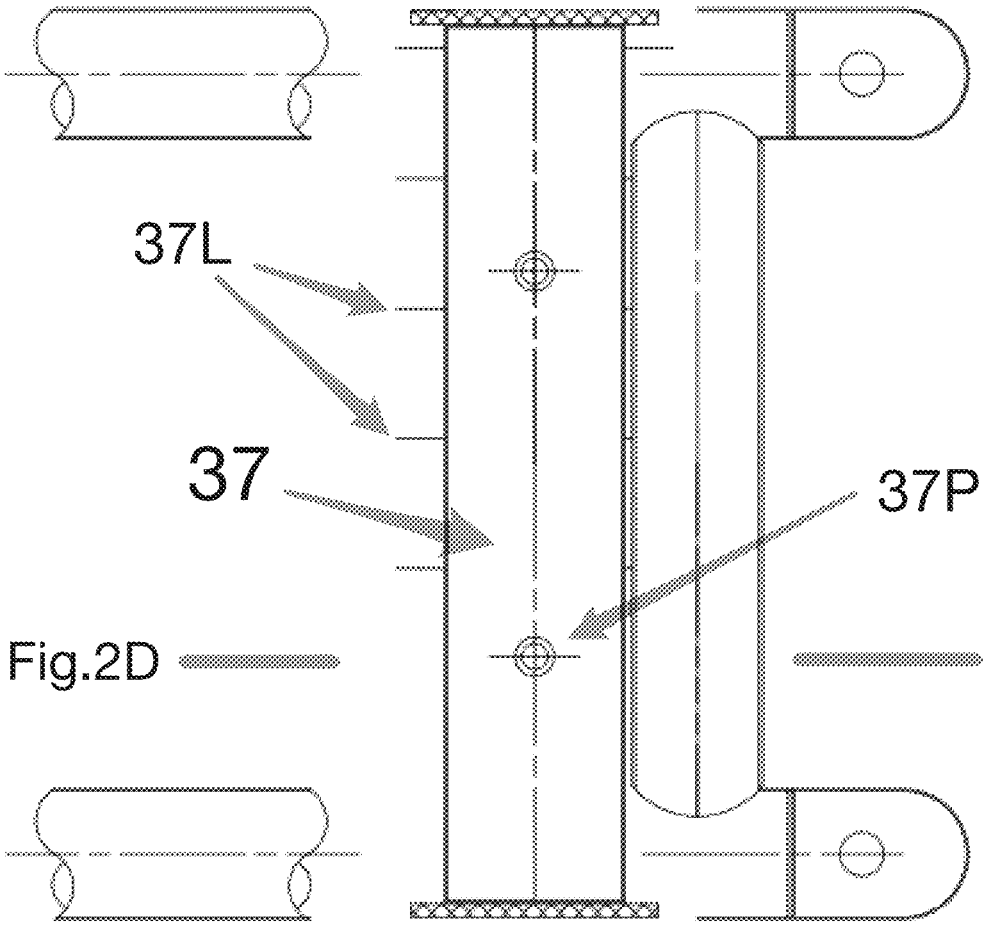
FIG. 2D is a section through a leg and sleeve showing the use of additional parts to produce asymmetrical clearances.

FIG. 2E is a side elevation of a leg sleeve in a truss section with truss main chords interrupted for visibility.

Figure 3A:
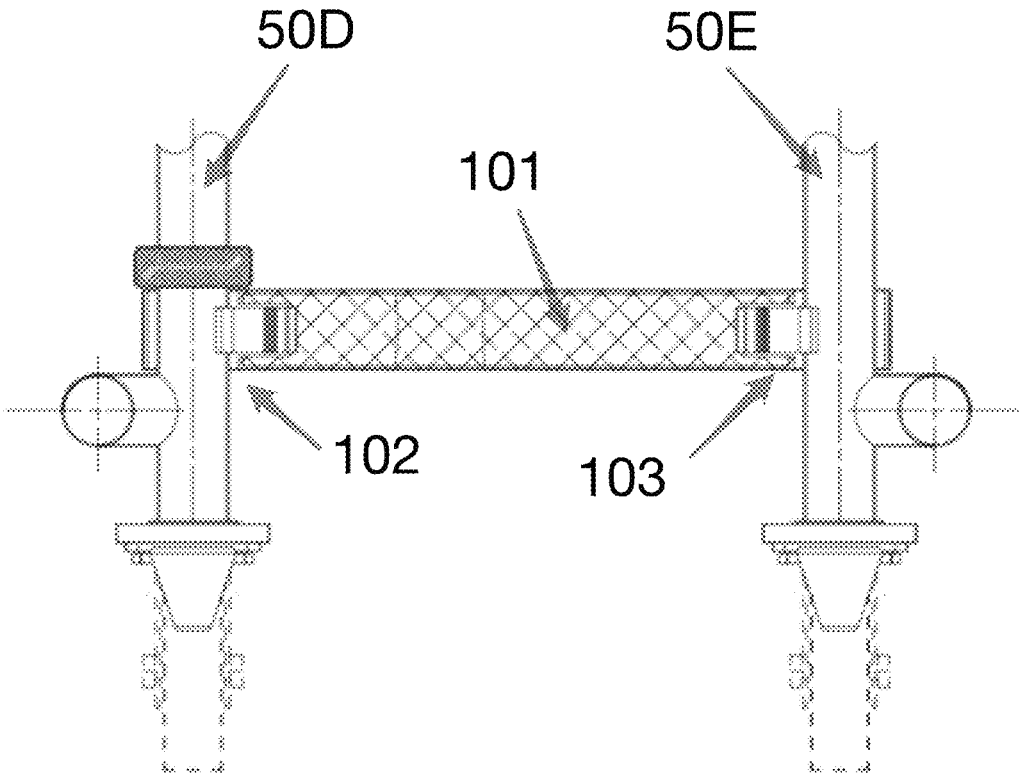

FIG. 3A is an end elevation of a pair of leg carriages in supporting a truss section, showing a stiffener maintaining the distance between them.

Figure 3B:
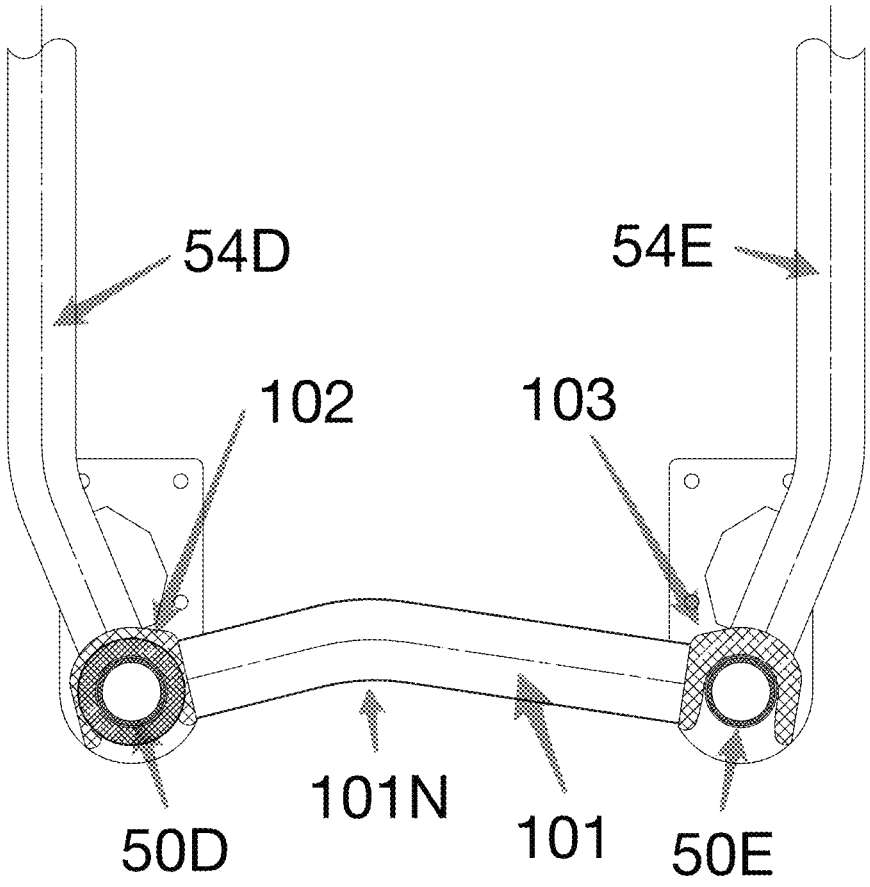

FIG. 3B is a plan view of the subject matter of the prior Figure.

Figure 3C:
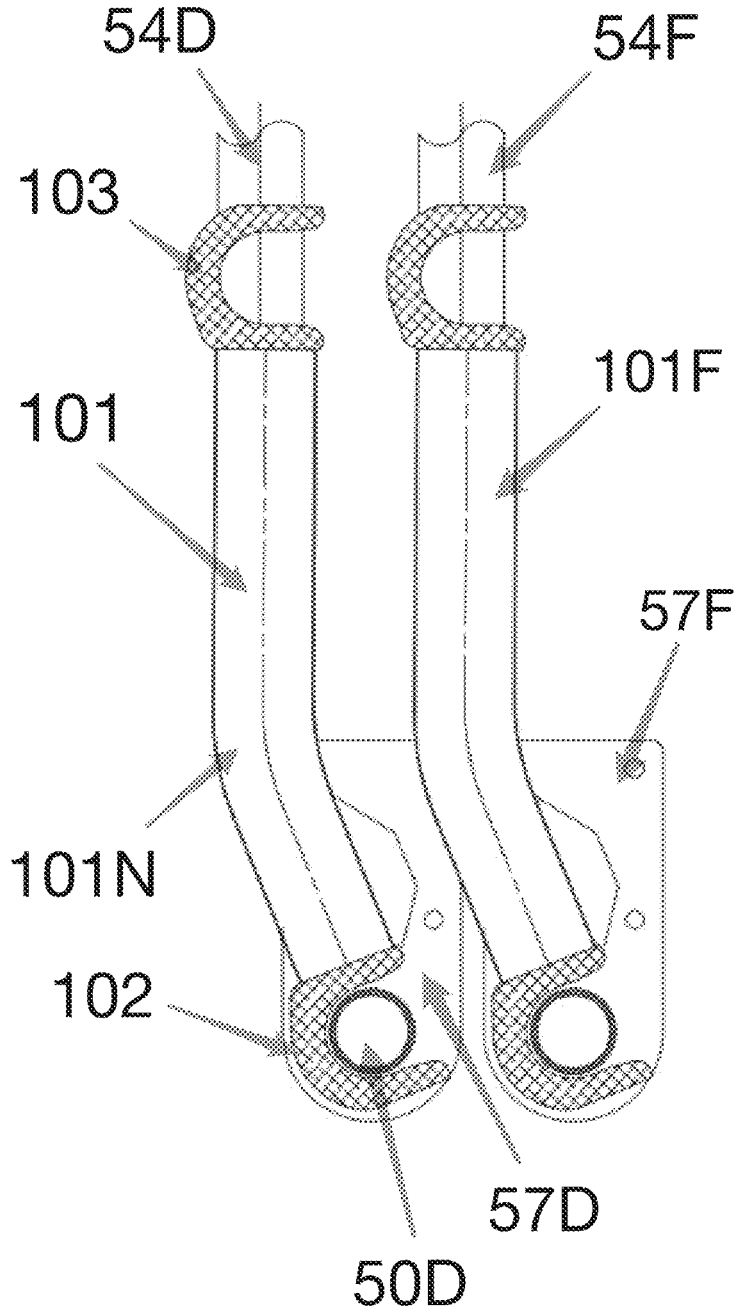

FIG. 3C is a plan view of two leg carriages disposed in parallel, showing the stiffener of the prior Figures as rotated into a storage position.

Figure 4A:
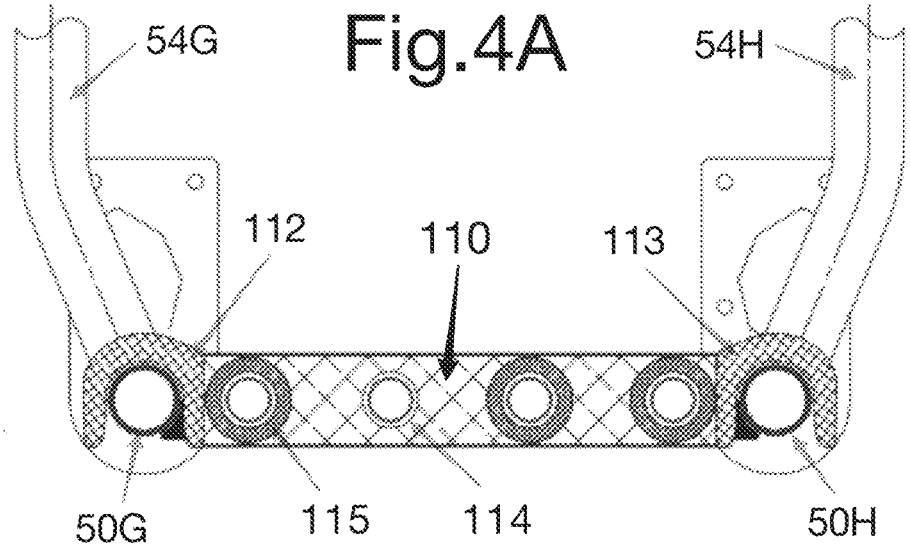

FIG. 4A is a plan view of an adaptor for storing leg carriages, attached between two leg carriages and providing stations for supporting additional leg carriages along its length.

Figure 4B:
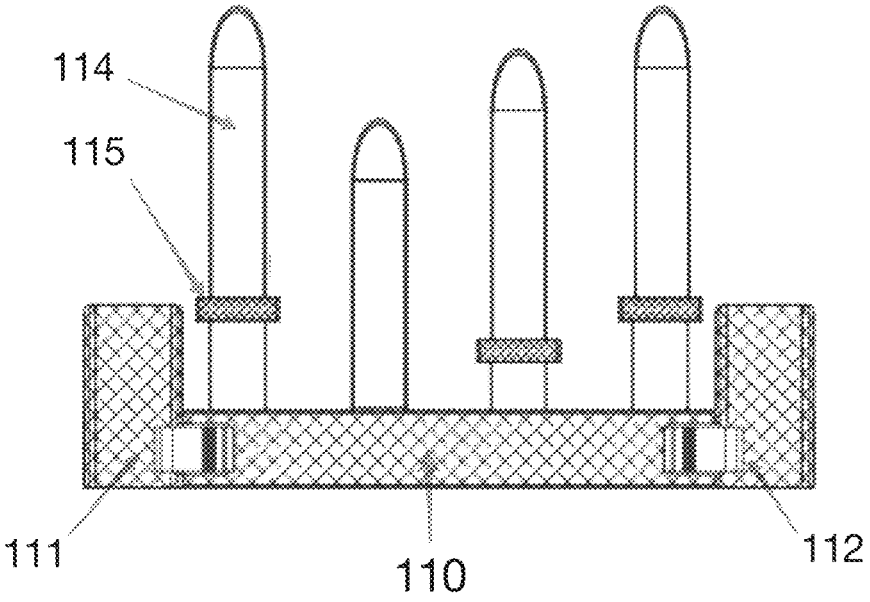

FIG. 4B is an elevation of the adaptor of the prior Figure.

Figure 4C:
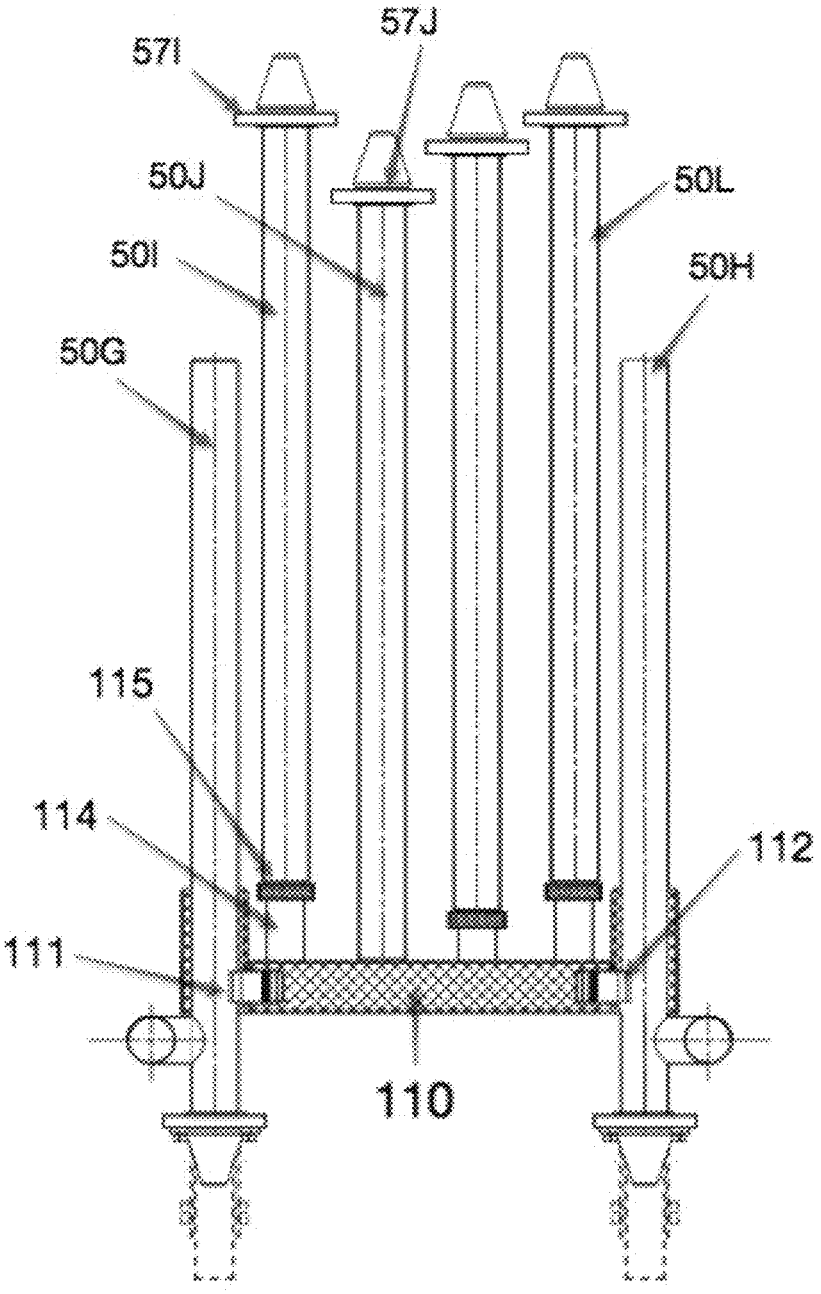

FIG. 4C is an end elevation of the adaptor of the prior Figures in use, illustrating how offsetting some of the additional leg carriages vertically allows increasing the number accommodated.

Figure 4D:
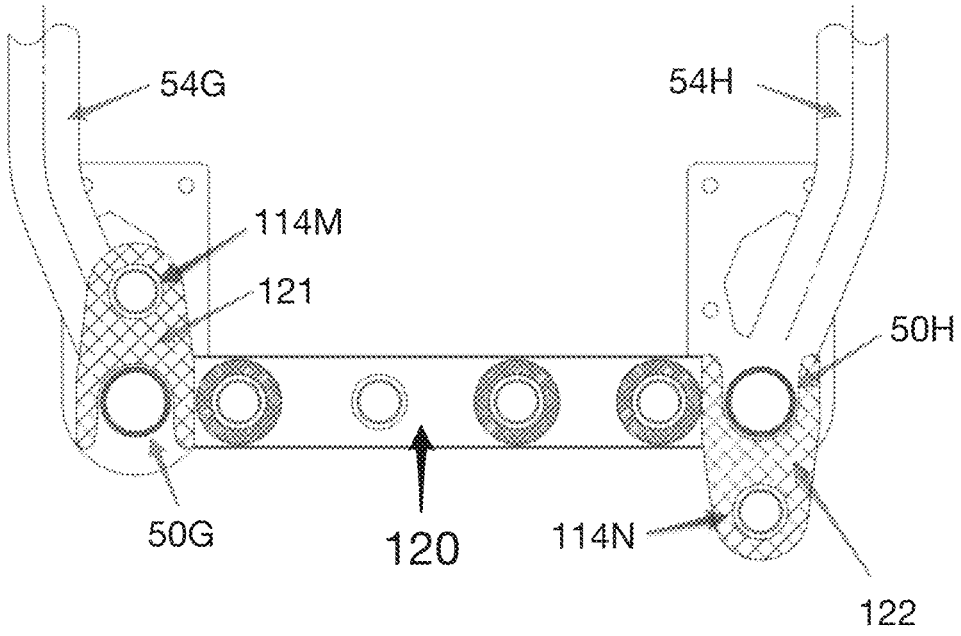

FIG. 4D is a plan view of an adaptor providing additional stations in the elongated axis of the leg carriages to increase the number accommodated.

Figure 4E:
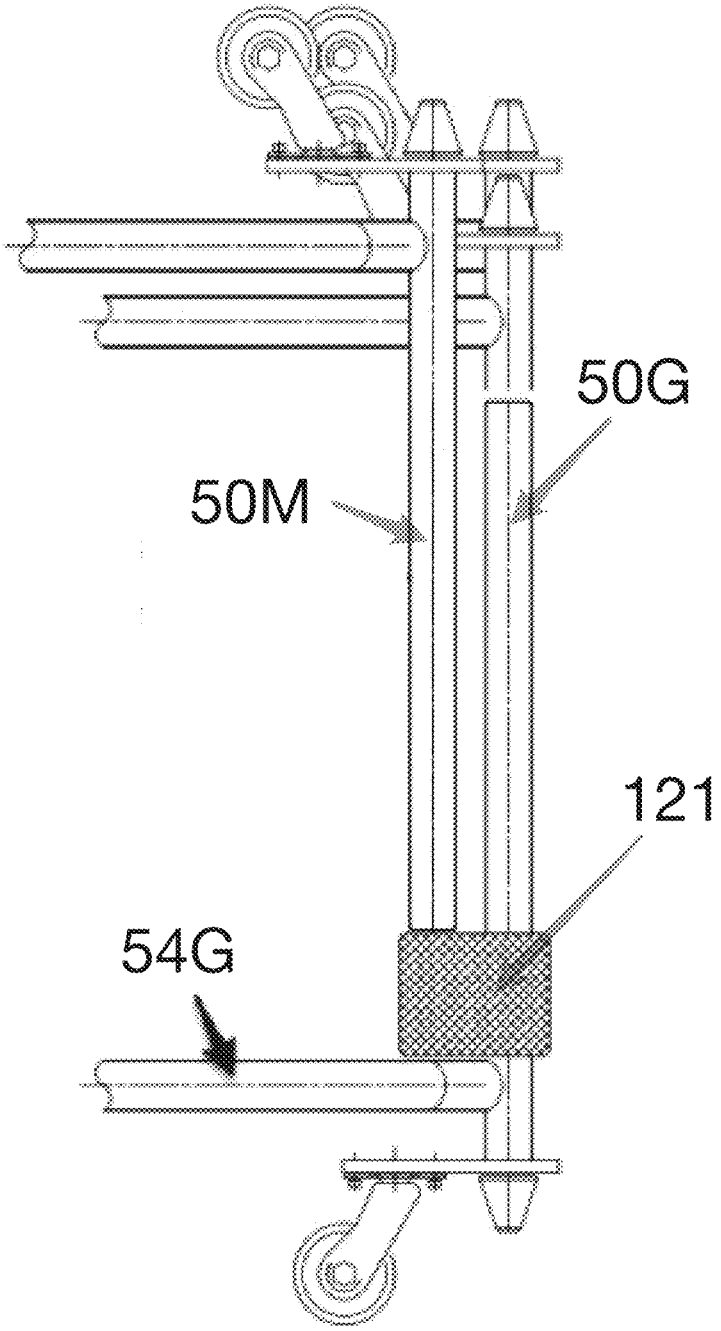

FIG. 4E is a side elevation of the adaptor of the prior Figures in use.

FIG. 5A is an end elevation of an extruded shape as might be used in fabricating a leg carriage hinge assembly in the relationship of the upper portion of the assembly with a truss.

FIG. 5B is an end elevation illustrating one cross-section along the part after machining.

FIG. 5C is an end elevation illustrating the other cross-section along the part after machining.

Figure 5D:
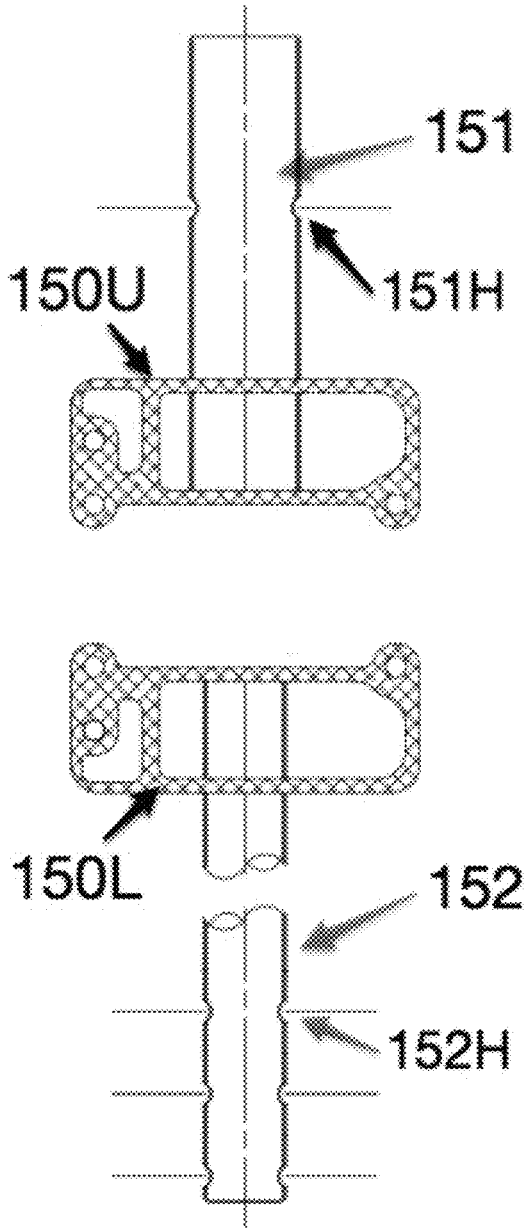

FIG. 5D is an end elevation illustrating two machined parts with the addition of cylindrical members.

Figure 5E:
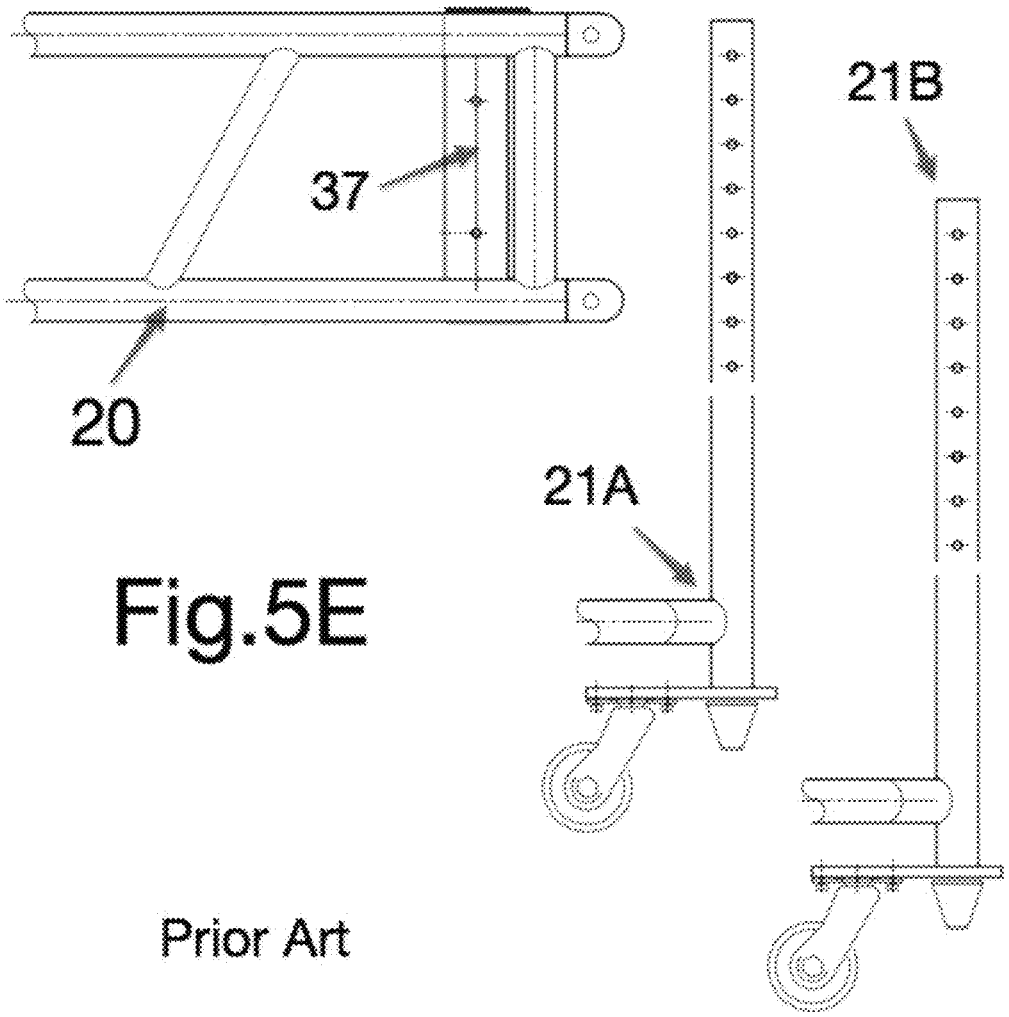
Fig.5E Prior Art

FIG. 5E is a side elevation illustrating the range of heights/ground clearance possible in prior art leg carriage trusses.

Figures 5F, 5G, 5H:
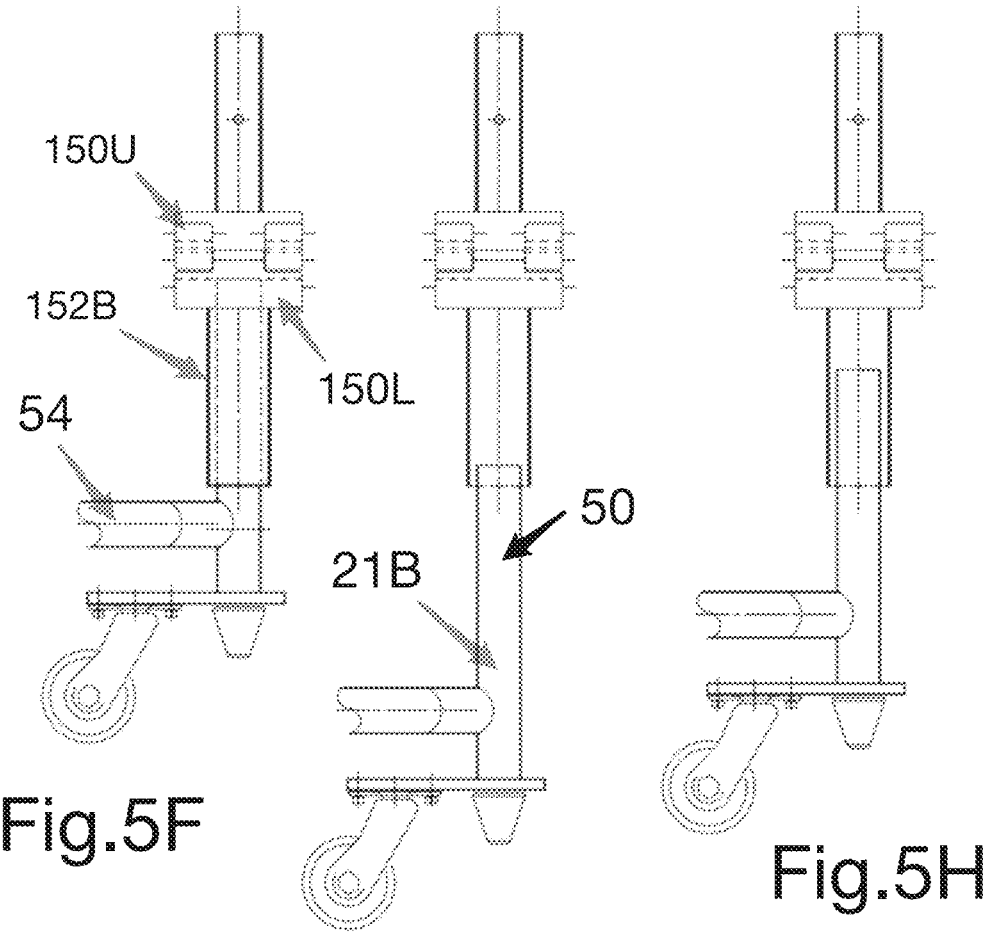

FIG. 5F is a side elevation illustrating a minimum height/ground clearance for one hinge adaptor design and leg length.

FIG. 5G is a side elevation illustrating the result of attempting to match the height/ground clearance illustrated in FIG. 5E using the hinge adaptor design and leg length of the prior Figure.

FIG. 5H is a side elevation illustrating the effect on maximum ground clearance with a more practical engagement between the hinge fitting adaptor and the leg length of the prior Figures.

Figure 5I:
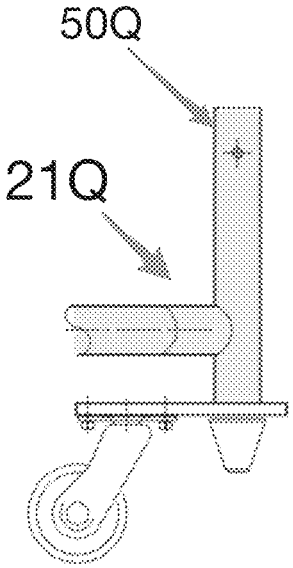

FIG. 5I is a side elevation illustrating a leg trimmed for a low hinge height/ground clearance.

Figure 5J:
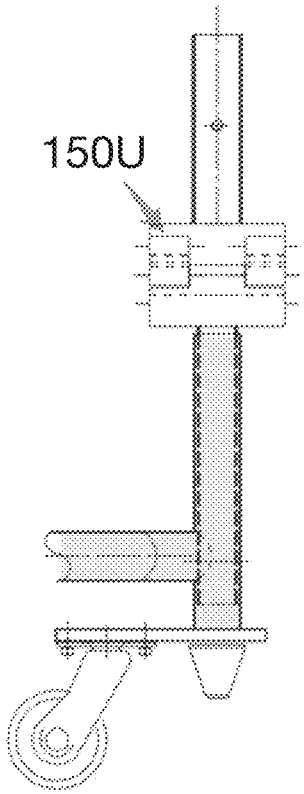

FIG. 5J is a side elevation illustrating a hinge adaptor having its lower part extending inside the leg.

Figure 5K:
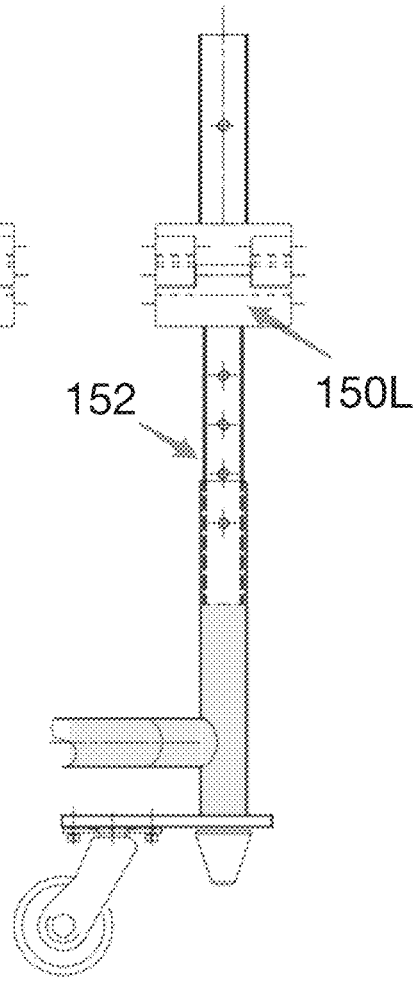

FIG. 5K is a side elevation illustrating the improvement possible in maximum height/ground clearance offered by the internal extension of the prior Figure.

FIG. 6A is a section through an example structural shape that can be spliced to round stock.

FIG. 6B is a section through the structural shape of the previous Figure illustrating the use of a roll pin in connecting to round stock.

FIG. 6C is a section through the structural shape of the previous Figures illustrating the internal mounting of a prior art linear LED product.

FIG. 6D is a section through the structural shape of the previous Figures illustrating the internal mounting of an LED assembly.

FIG. 6E is a section through the structural shape of the previous Figures illustrating an angled LED.

Figure 6F:
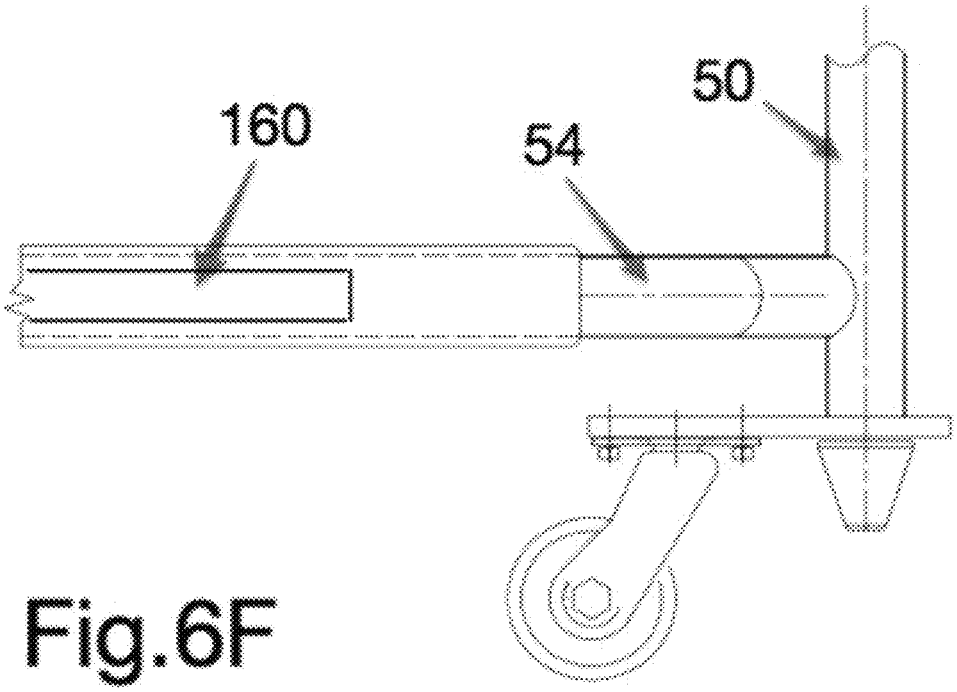

FIG. 6F is a side elevation of the structural shape of the previous Figures spliced into a prior art leg carriage.

FIG. 6G is a side elevation of a truss with an inverted leg carriage including the illustrated structural shape enclosing an LED assembly.

FIG. 6H is a section through a structure shape of increased height to accommodate a larger LED assembly.

FIG. 6I is a section through a hybrid combination of a structural shape and a larger enclosure.

Figure 6J:
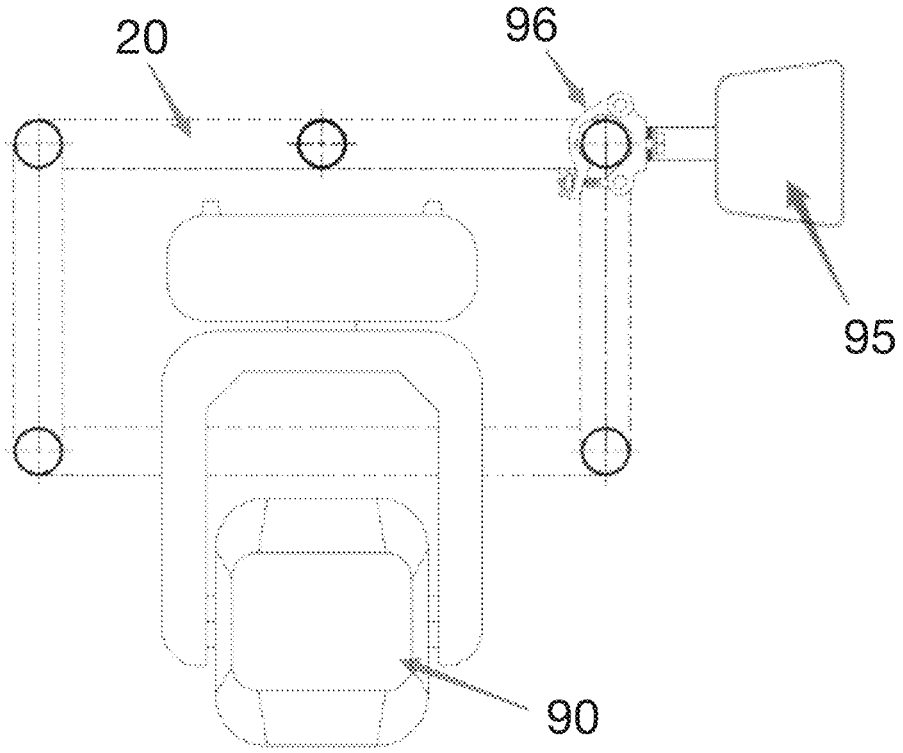

FIG. 6J is a section through a "pre-rig" truss showing the addition of wholly external fixture attached to a truss chord.

FIG. 6K is a section through an example structural shape that can be attached to round tube stock for mounting a linear LED.

FIG. 6M is a section through the example structural shape of the prior figure illustrating its ability to adjust in radial angle.

Figure 6N:
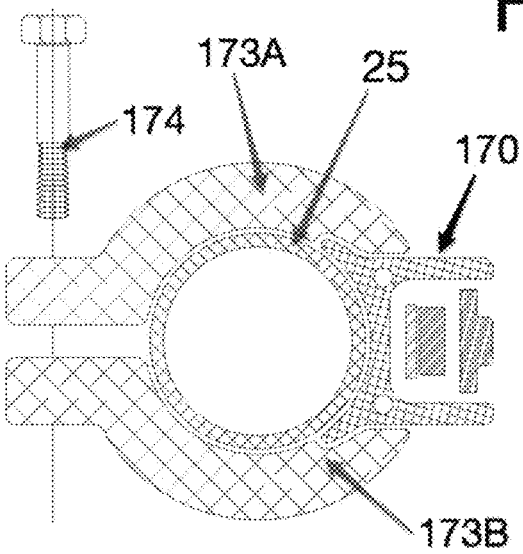

FIG. 6N is a sectional view of the structural shape of the previous Figures illustrating a fitting for attaching said shape to a round tube.

Figure 6O:
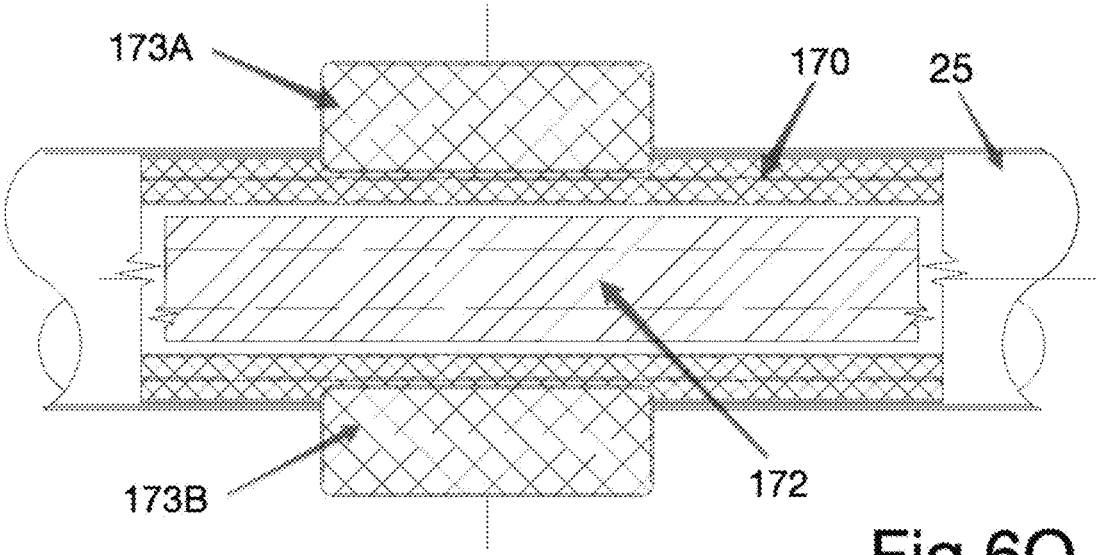

FIG. 6O is an elevation showing the attachment of the structural shape by the fitting to a round tube.

Figure 7A:
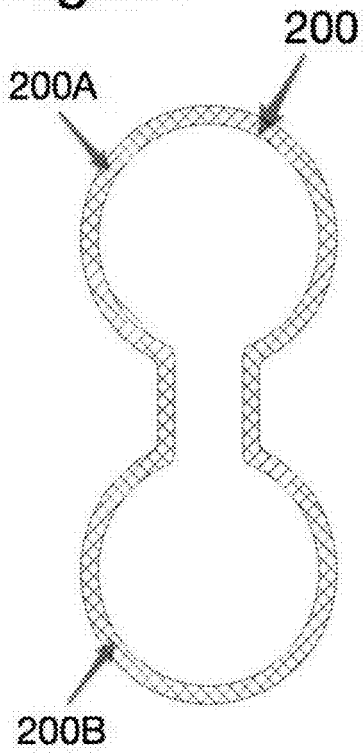

FIG. 7A is an example dual lobe structural shape intended to provide higher stiffness with other advantages.

Figure 7B:
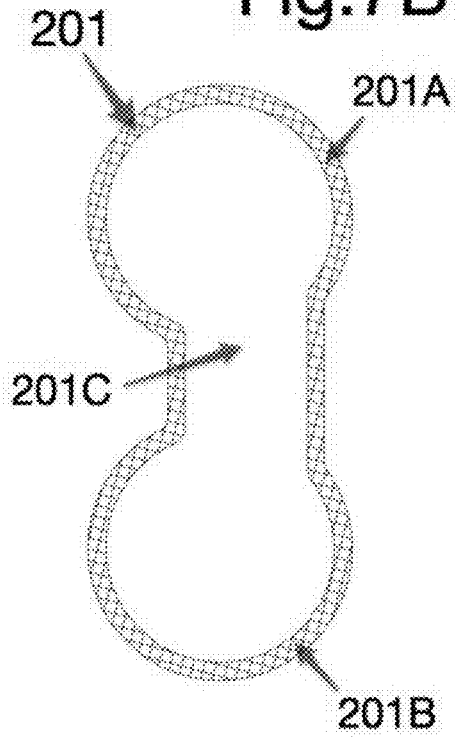

FIG. 7B is an example dual lobe structural shape intended to provide higher stiffness with other advantages and having an internal volume sufficient to enclose wiring.

FIG. 7C demonstrates the compatibility of a dual lobe structural shape with prior art "snap-latch" fittings.

FIG. 7D is an example dual lobe structural shape providing a stiffened slot.

FIG. 7E is an example dual lobe structural shape providing internal stiffening.

FIG. 7F is an example dual lobe structural shape providing internal stiffening.

Figure 7G:
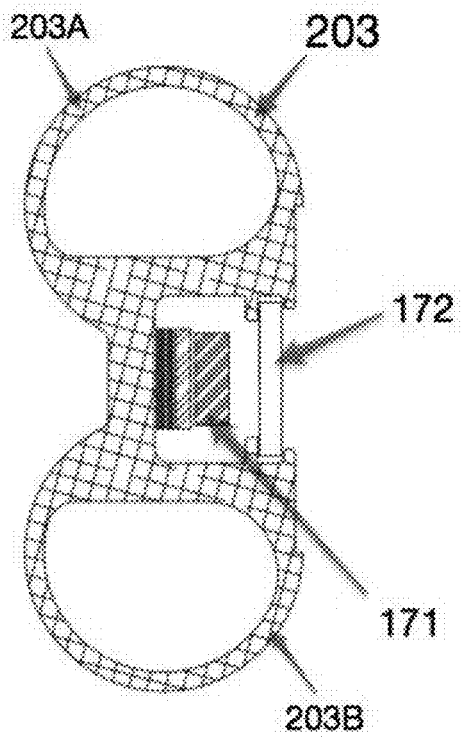

FIG. 7G is an example dual lobe structural shape also providing for internal mounting of a linear LED assembly.

Figure 7H:
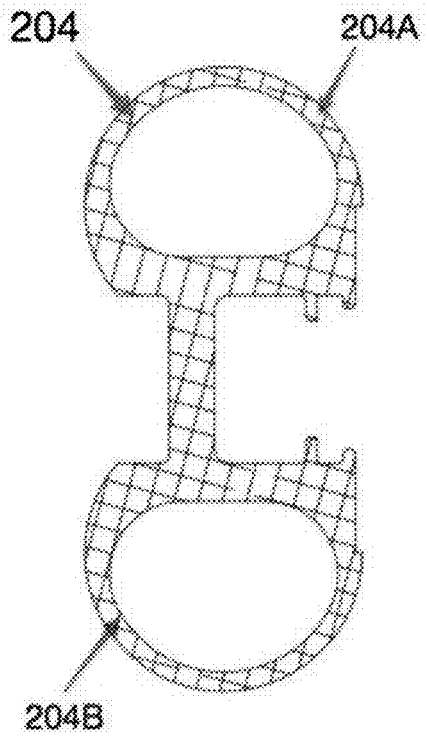

FIG. 7H is another example dual lobe structural shape also providing for internal mounting of a linear LED assembly.

FIG. 7I is a plan view of a simple fitting for attaching fixtures and other loads to the dual lobe structural shape of the prior Figures.

FIG. 7J is one side elevation of the body of the fitting of the prior Figure.

FIG. 7K is an end elevation of the fitting of the prior Figures resting on a dual lobe structural shape and with the hardware used to lock it to the structural shape and to attach a fixture or other load to it.

FIG. 7L is the other side elevation of the body of the fitting of the prior Figures.

Figure 7M:
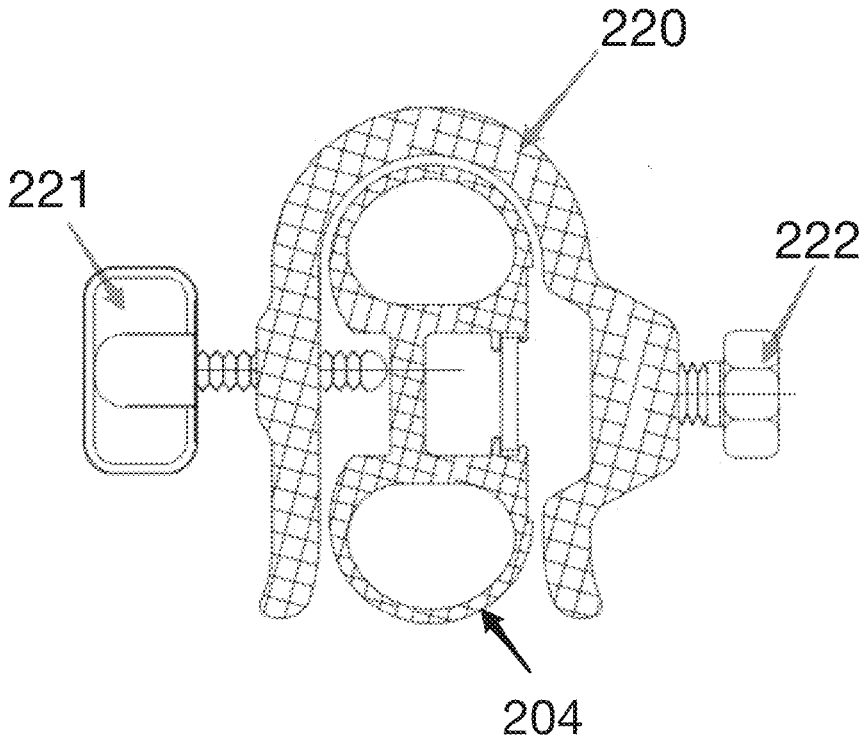

FIG. 7M is a sectional view/end elevation illustrating a dual lobe structural shape having a recess suitable for an internal LED assembly and using the fitting of the prior Figures.

Figure 7N:
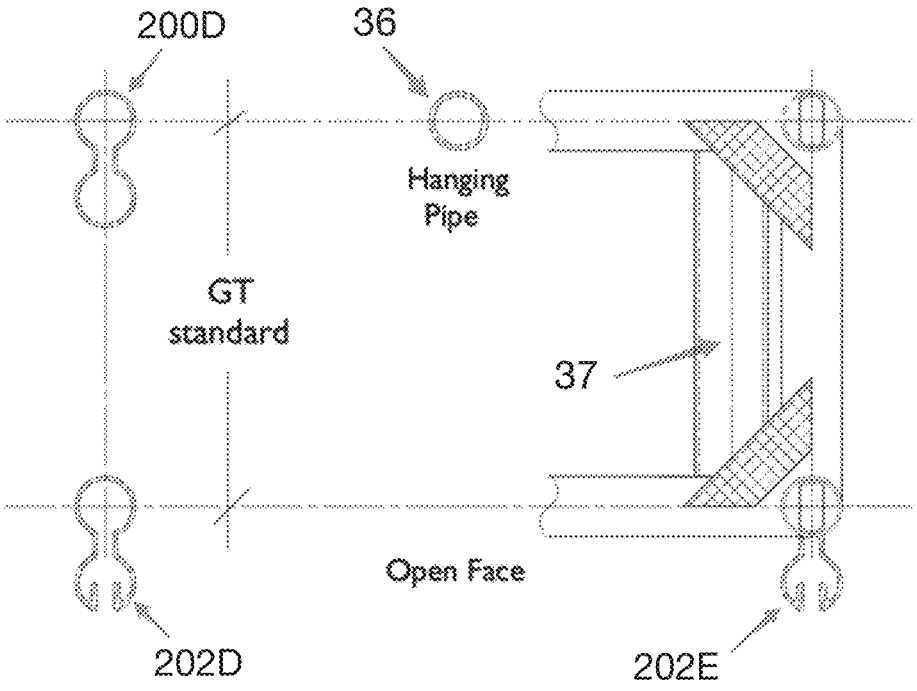

FIG. 7N is a part section and part end elevation showing one possible application of dual lobe shapes in a truss such as "pre-rig".

Figure 7O:
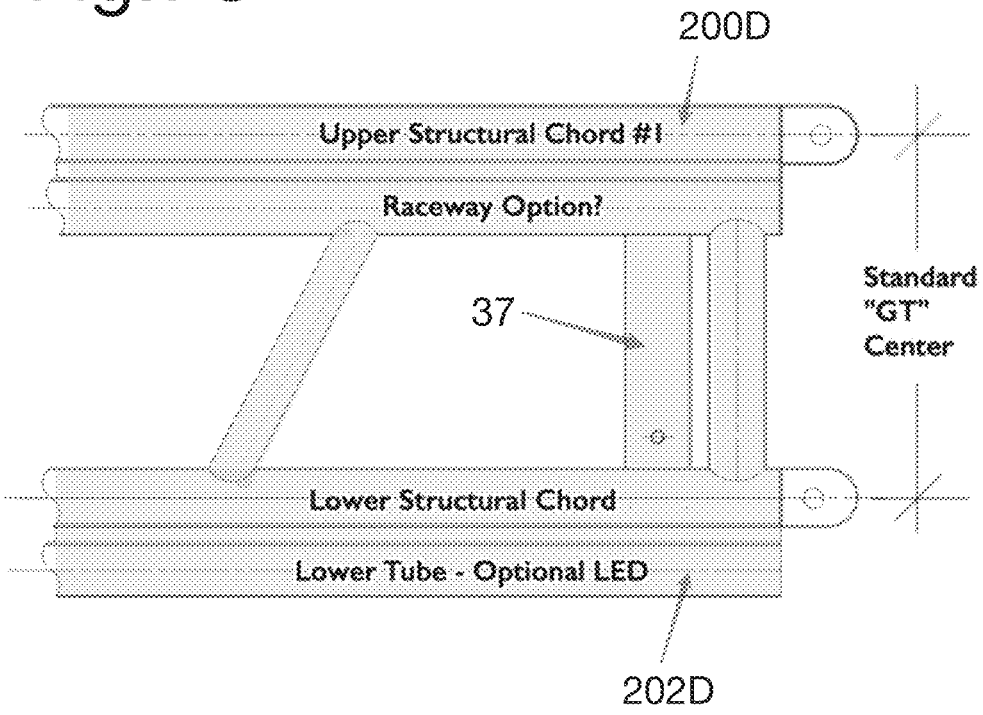

FIG. 7O is a side elevation of the example application of the previous Figure.

FIG. 7P is a sectioned side elevation of the double lobe shape as used with splice plates in attachment of cross-bracing.

FIG. 7Q is an end-oriented section of the subject matter of the previous Figure.

Figure 8A:
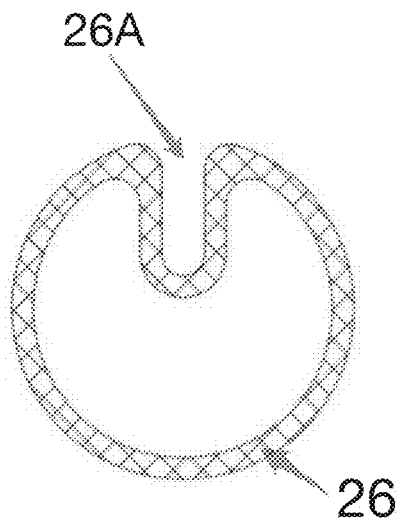

FIG. 8A is a section through a round tube shape including a keyway.

Figure 8B:
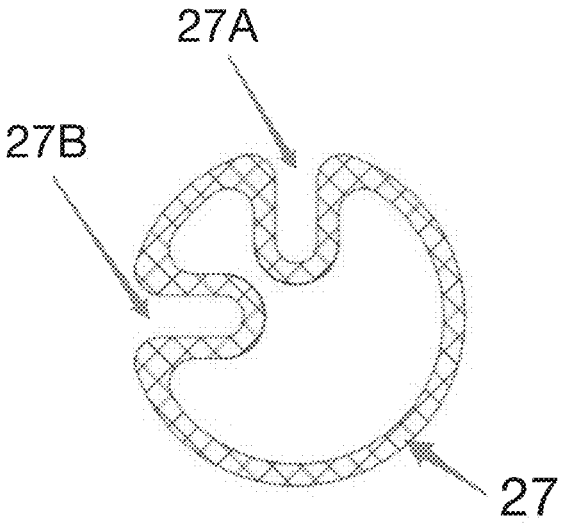

FIG. 8B is a section through a round tube shape including a plurality of keyways.

FIG. 8C is top view of a prior art fixture attaching clamp with the addition of a keying detail.

FIG. 8D is a side elevation of the subject clamp of the prior Figure.

FIG. 8E is a section through the subject clamp of the prior Figures showing an example installation of a fastener serving as a key.

FIG. 8F is a section through the subject clamp of the prior Figures as attached to and keyed by the example tube shape of FIG. 8A.

FIG. 8G is a perspective view of shape that can be used in keying.

FIG. 8H is a section through the prior art fixture attaching clamp of the prior Figures that uses the shape in FIG. 8G for keying.

Figure 9A:
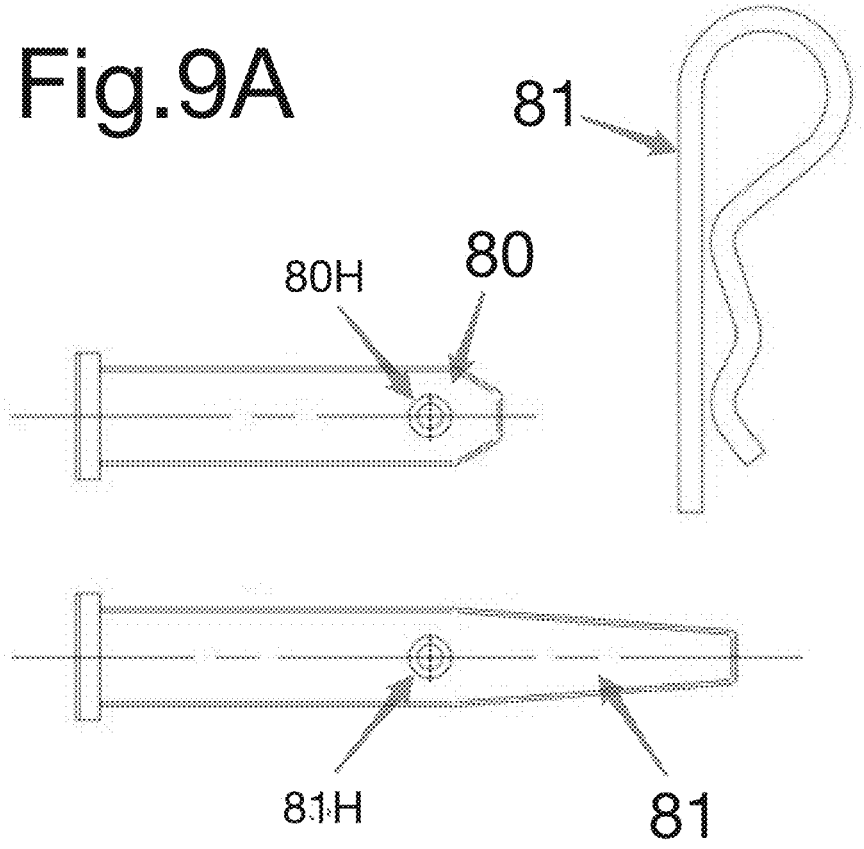

FIG. 9A is a comparative view of two types of steel pin used in coupling trusses using clevis fittings.

Figure 9B:
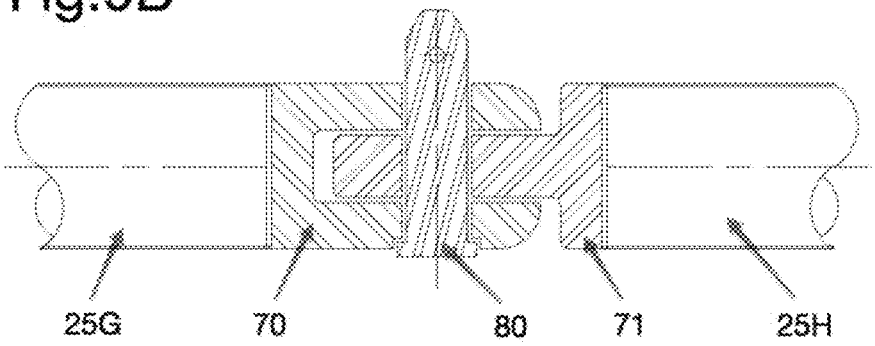

FIG. 9B is a section showing the short pin type in use coupling clevis fittings.

Figure 9C:
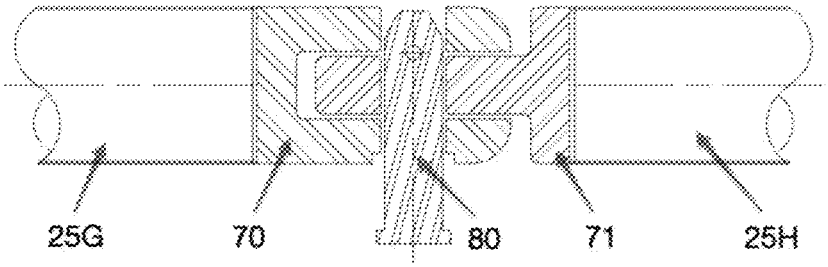

FIG. 9C is a section showing the short pin type driven flush to the fitting during removal.

Figure 9D:
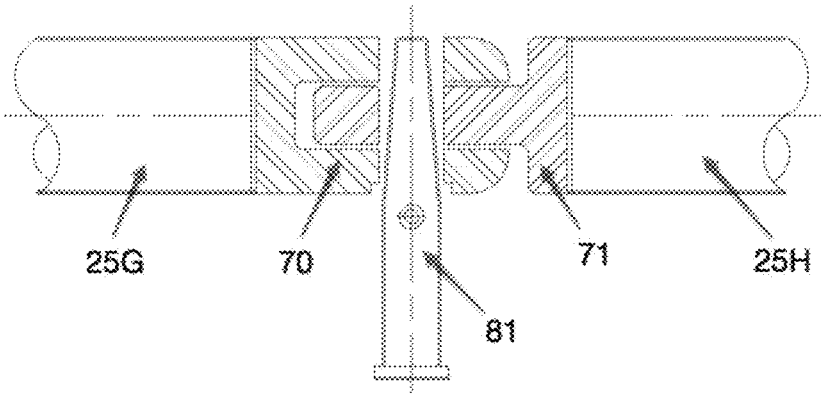

FIG. 9D is a section showing the long pin type in partial removal.

Figure 9E:
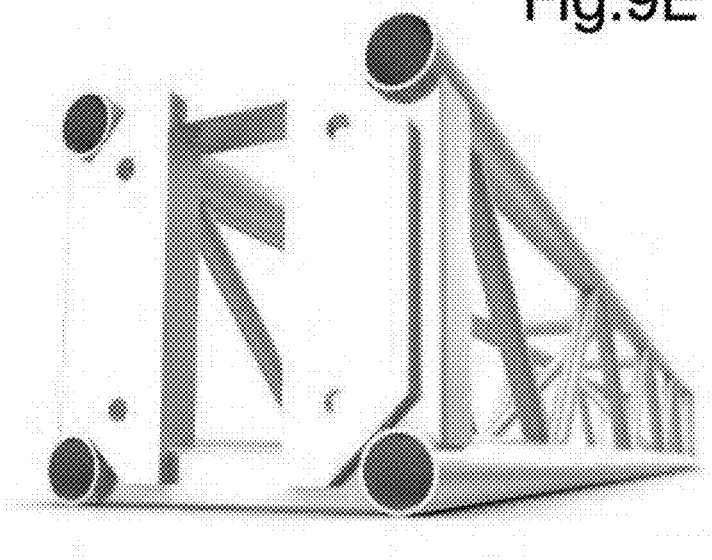

FIG. 9E is a view of generic "12×12" truss intended for bolted coupling.

Figure 9F:
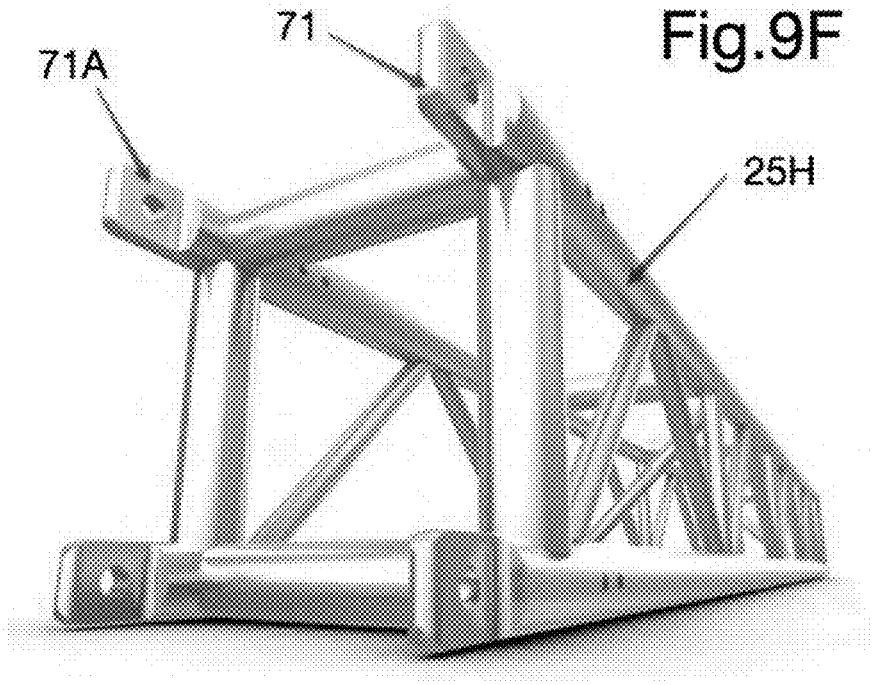

FIG. 9F is a view of generic "12×12" truss intended for coupling by clevis fittings.

Figure 9G:
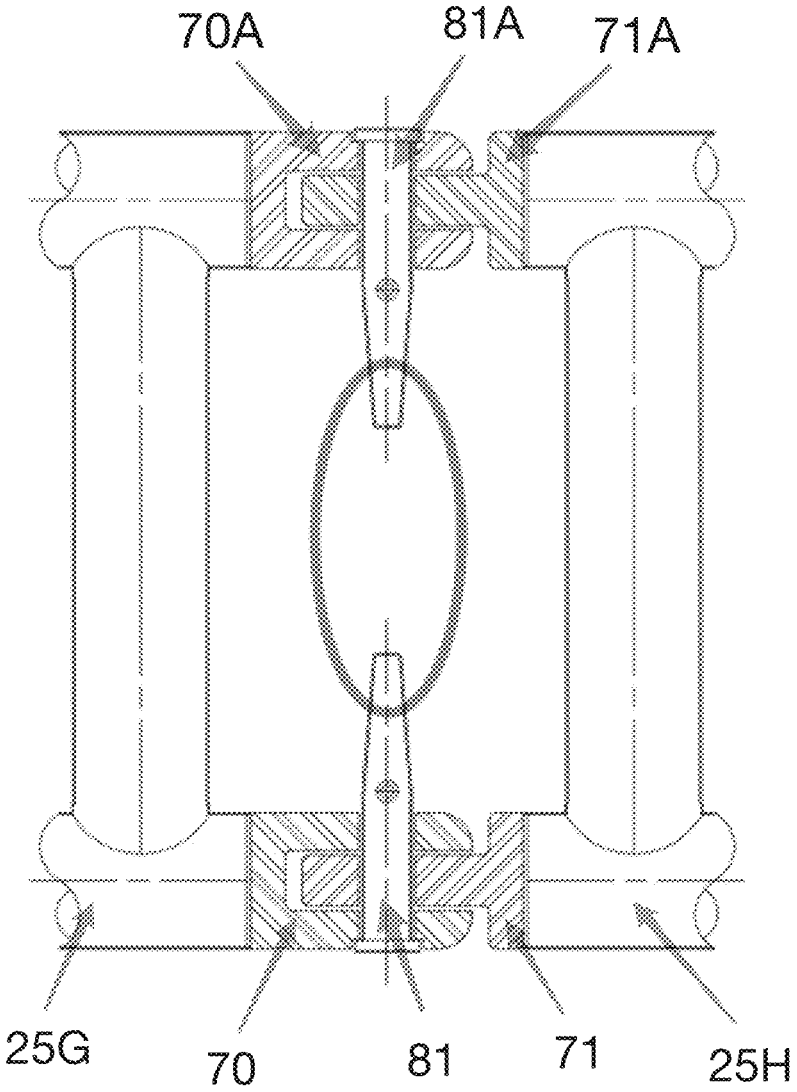

FIG. 9G is a sectional view showing the limited clearance between pins used in coupling such truss.

Figure 9H:
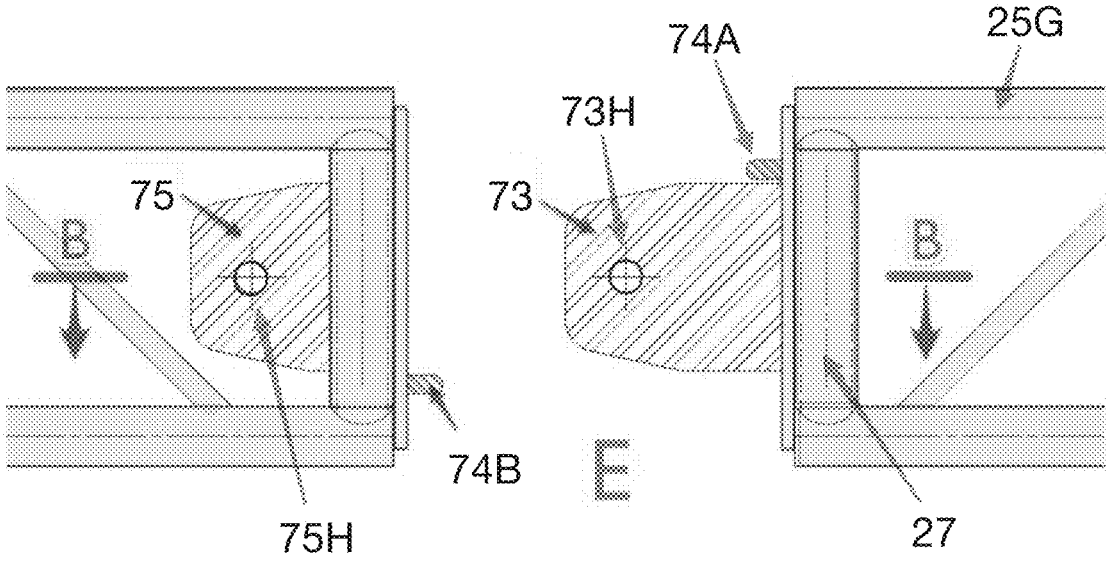

FIG. 9H is a side elevation of an improved method of coupling truss.

Figure 9I:
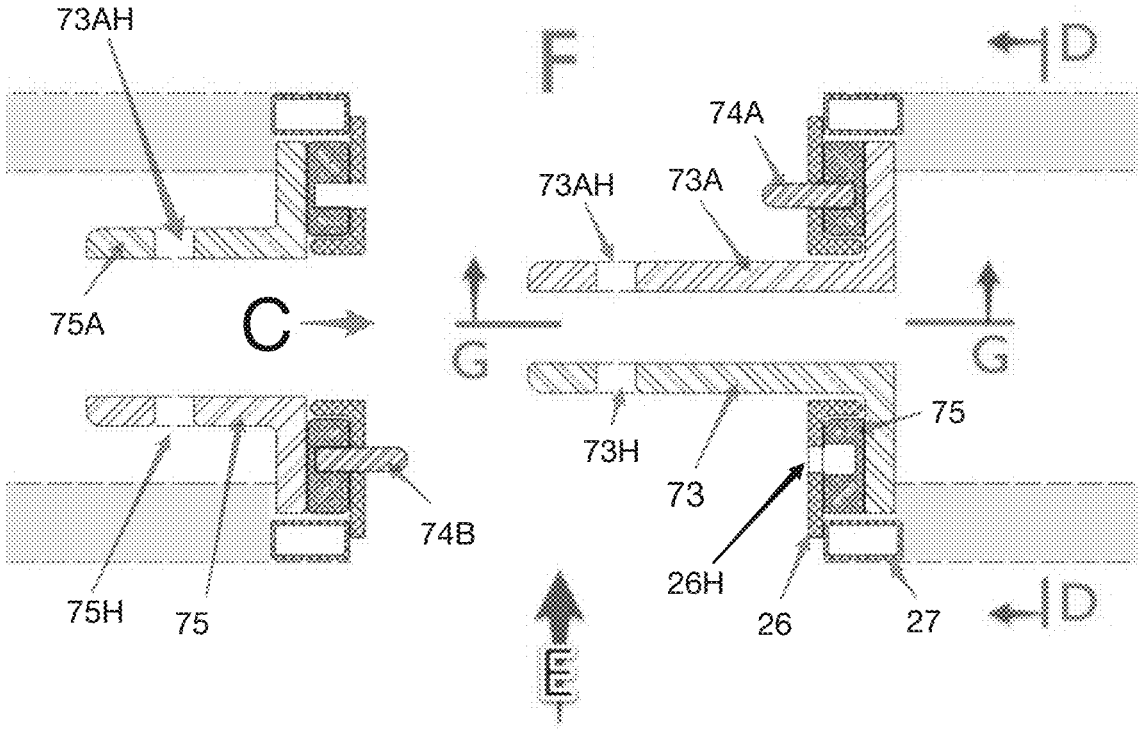

FIG. 9I is a sectional view in plan of the subject matter of the prior Figure.

Figure 9J:
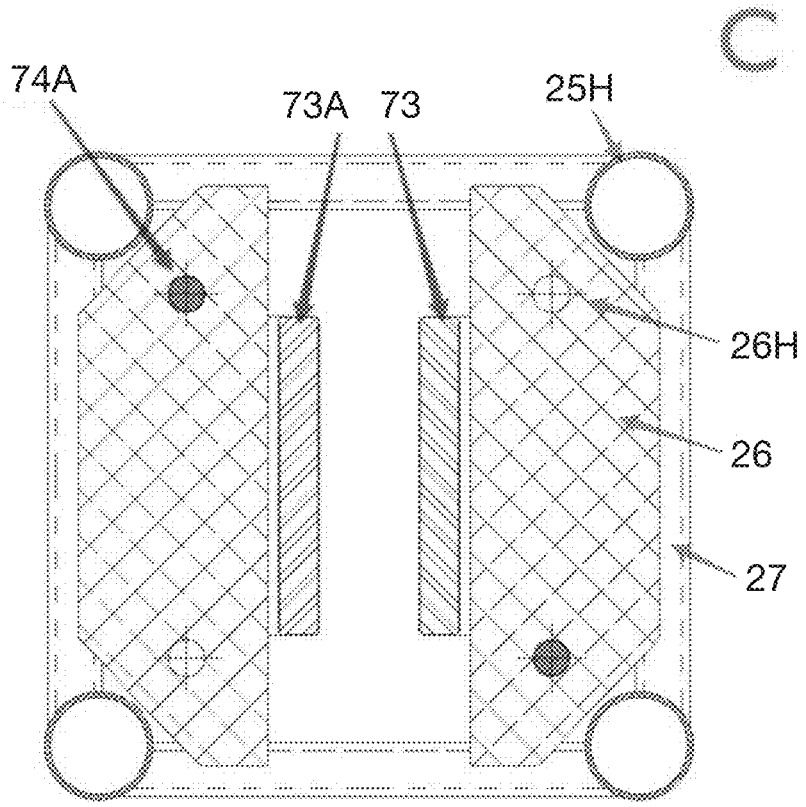

FIG. 9J is an end elevation of one of the truss ends of the prior Figures.

Figure 9K:
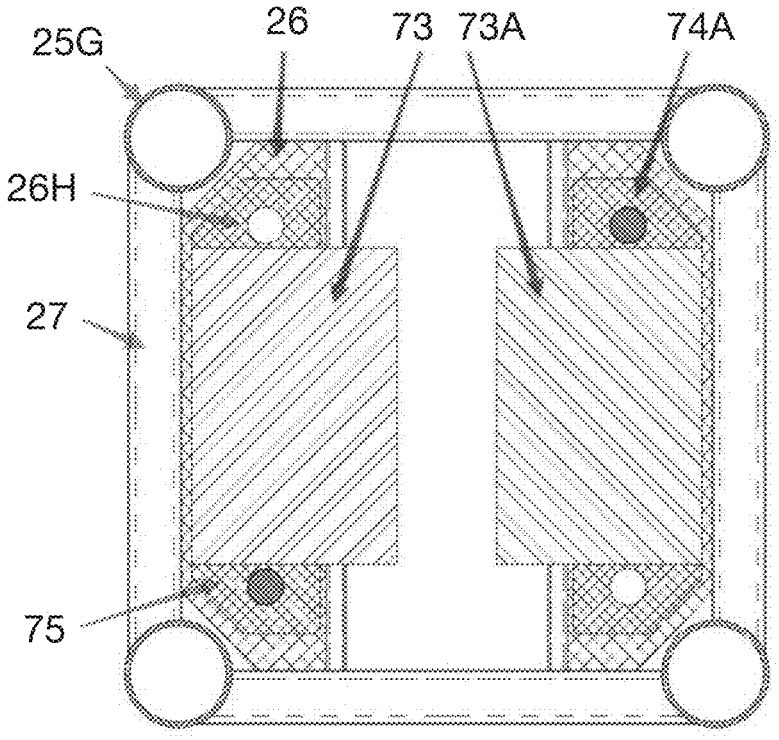

FIG. 9K is a reverse end elevation of the truss end of the prior Figure.

Figure 9L:
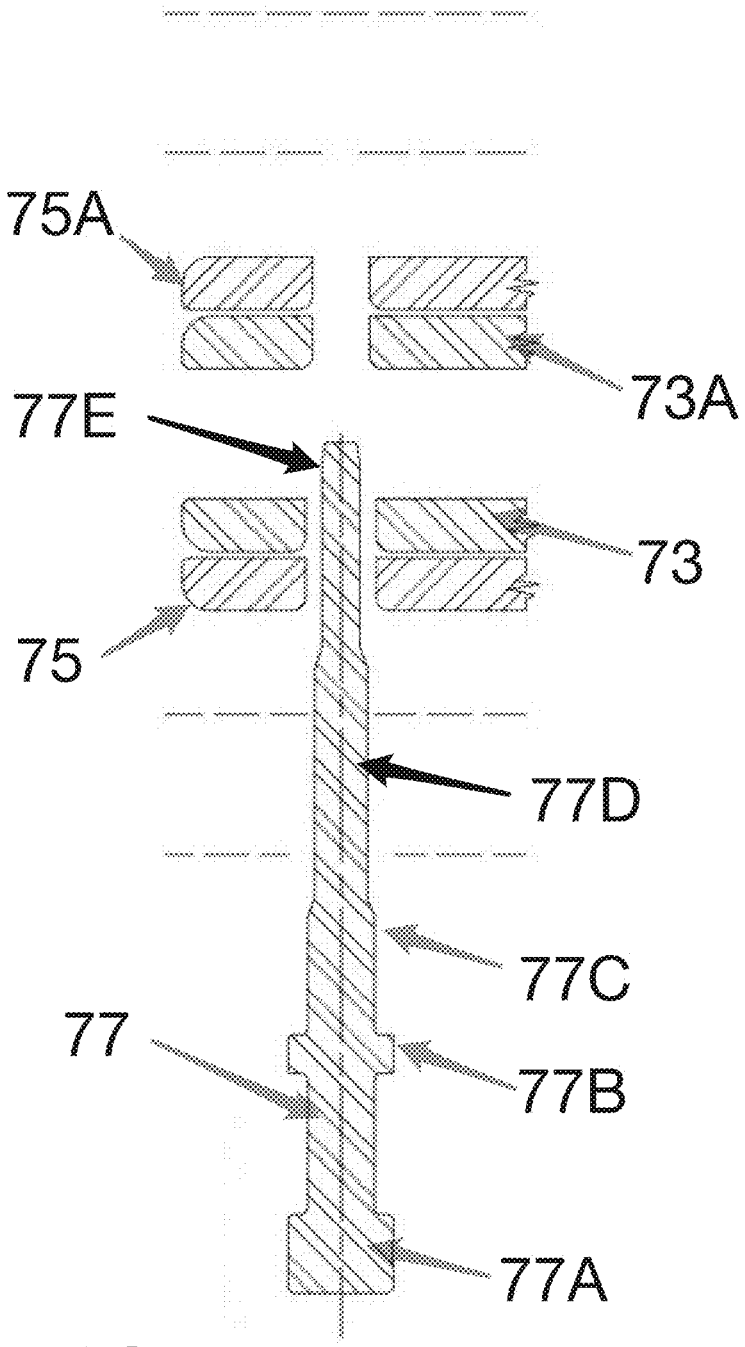

FIG. 9L is a sectional detail in plan of a multi-stage pin beginning insertion into aligned end fittings of the trusses in the prior Figures.

Figure 9M:
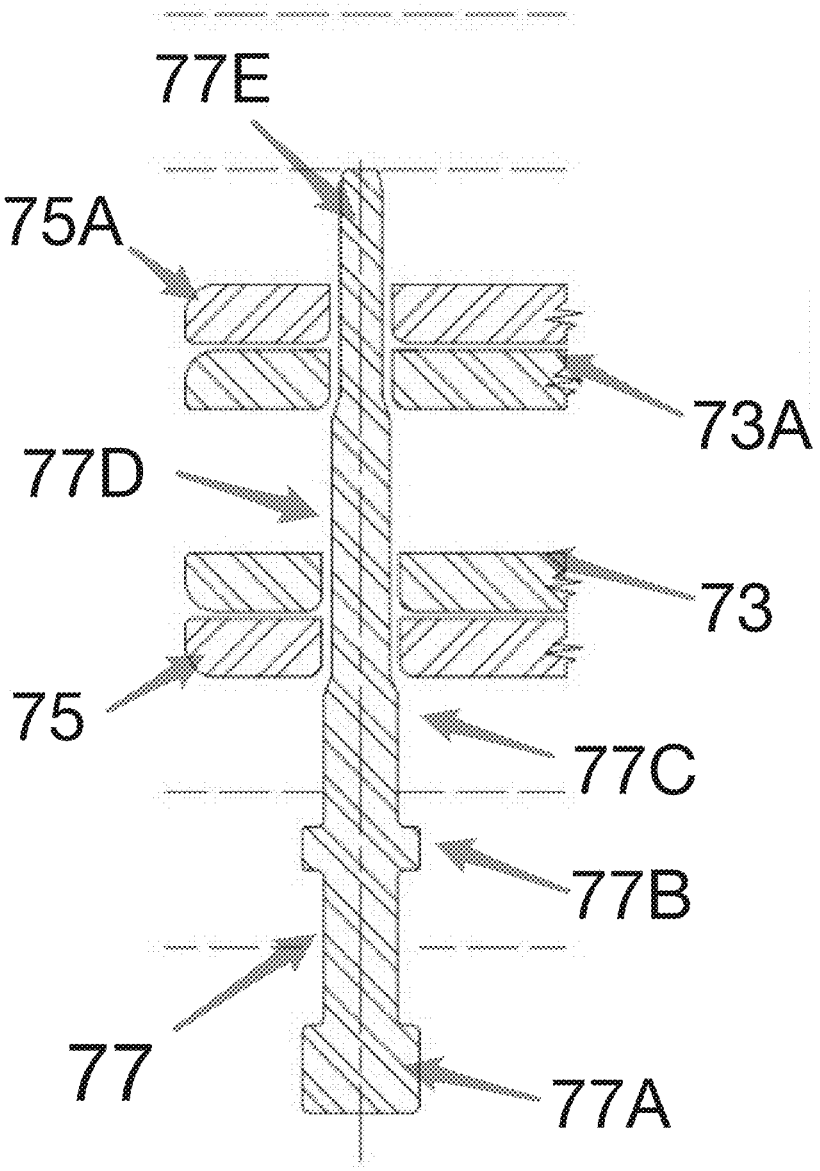

FIG. 9M is a sectional detail in plan of a multi-stage pin during insertion into aligned end fittings of the trusses in the prior Figures.

Figure 9N:
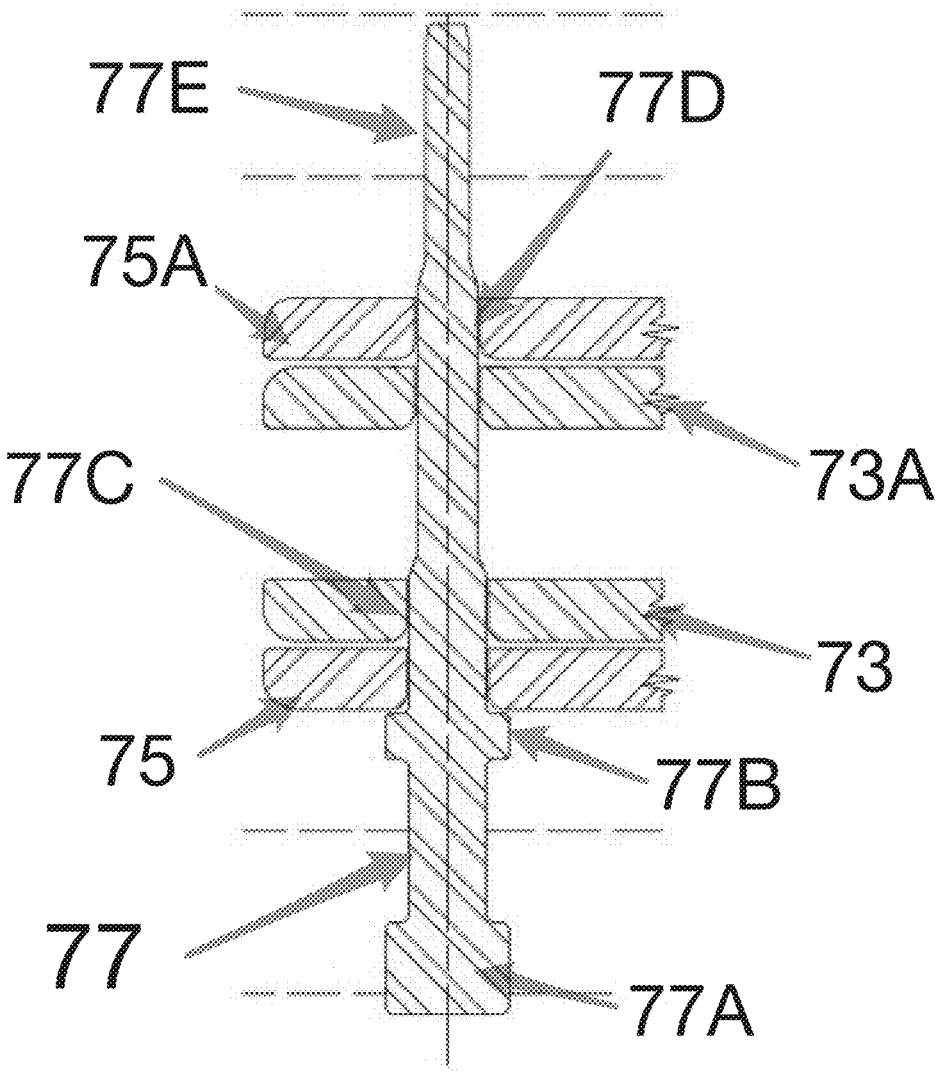
Figure 90:
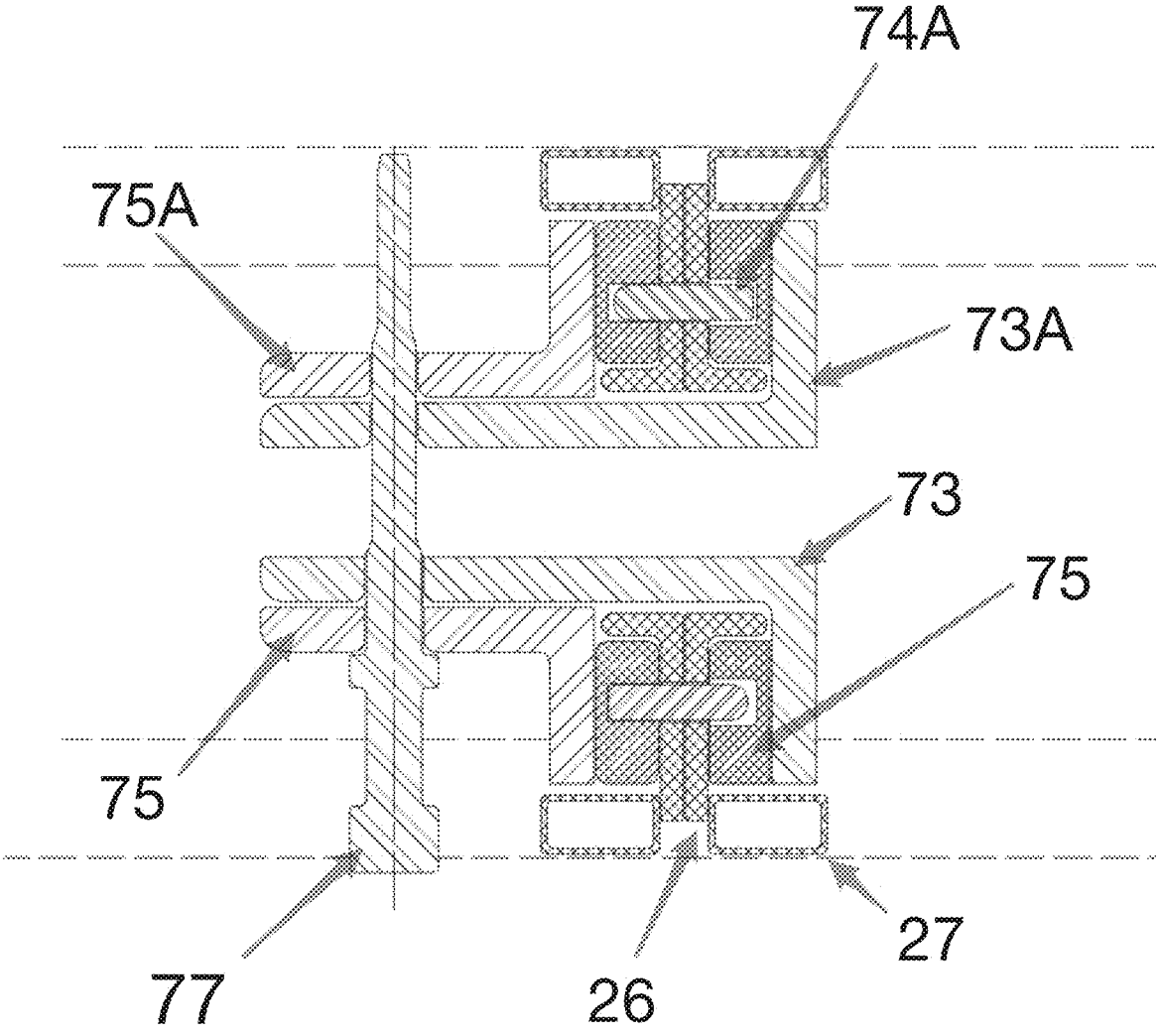

FIG. 9N is a sectional detail in plan of a multi-stage pin having completed insertion into aligned end fittings of the trusses in the prior Figures.

FIG. 9O is a sectional view in plan of a multi-stage pin having completed insertion into aligned end fittings of the trusses in the prior Figures.

DETAILED DESCRIPTION

One issue with prior art leg carriage trusses, including the Dodd/Tyler version and all subsequent variations thereof is leg insertion and removal.

Figure 1A:
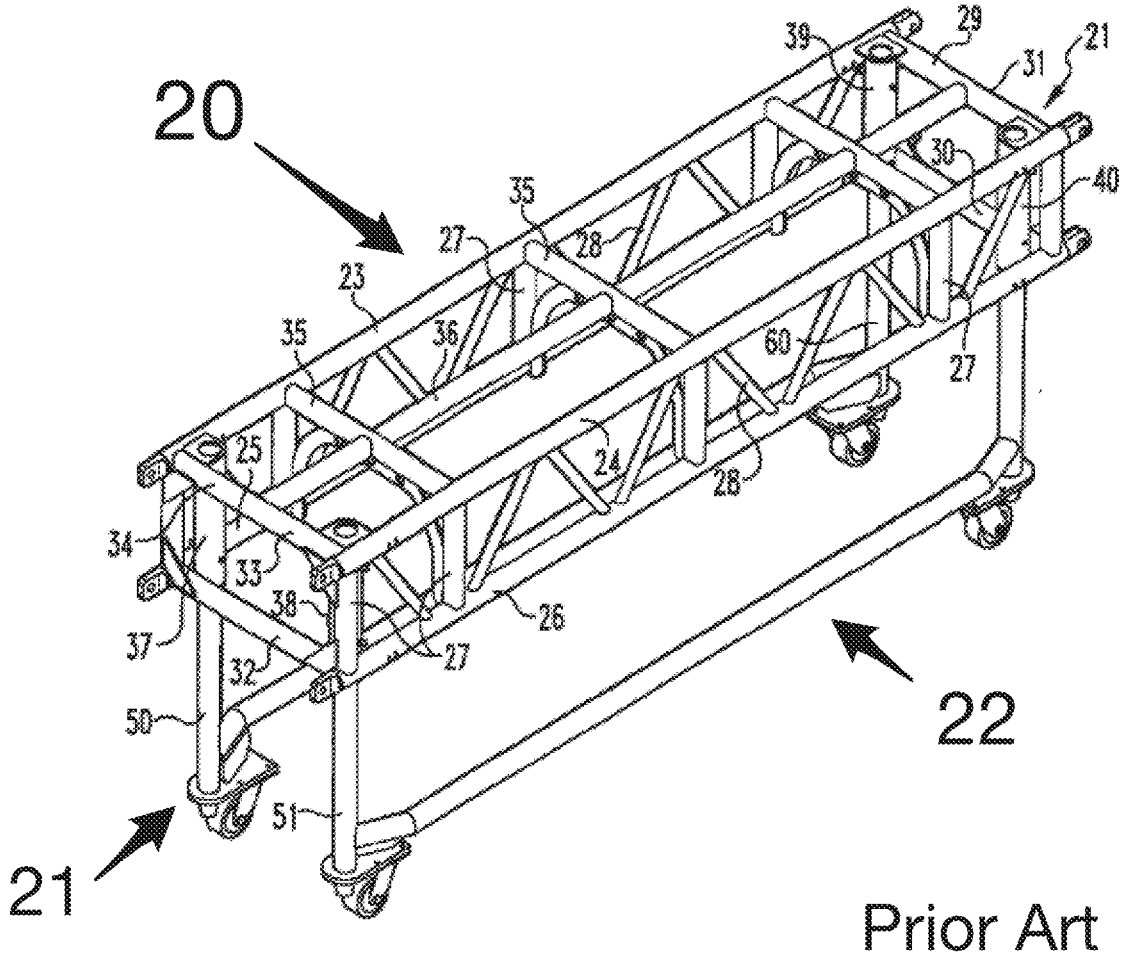
FIG. 1A is a general view of a prior art "leg carriage" type truss.
Figure 1B:
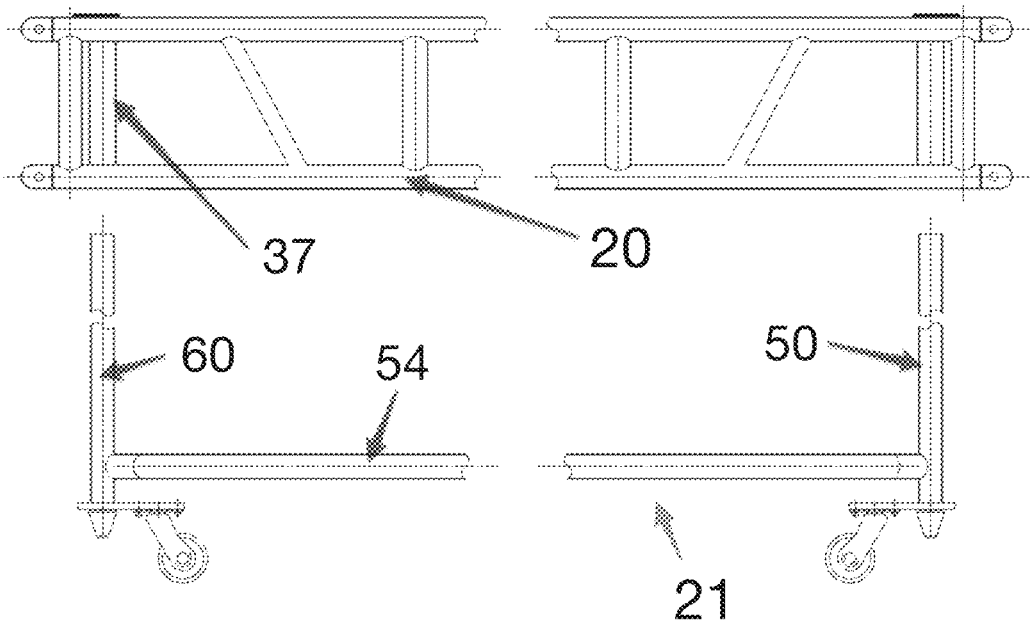
FIG. 1B is a side elevation showing a leg carriage separated from a truss section.
Figure 1C:
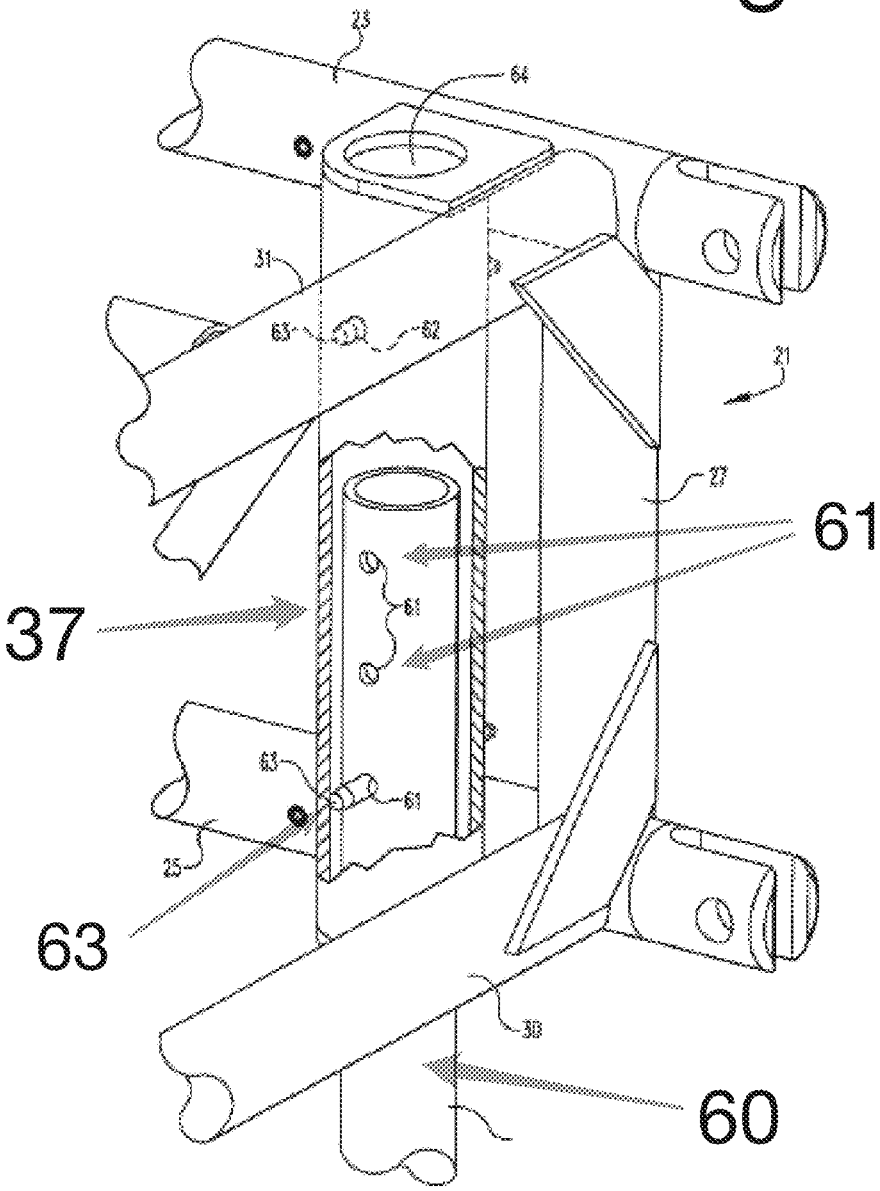
Prior Art Fig.1C
FIG. 1C is a detail of the relationship between a truss and a leg carriage when connected.

Referring to FIGS. 1A-1C, as is well understood, the load-bearing connections between the pair of leg carriages and a truss section rely upon insertion of legs (e.g., 50 and 60) into receiving sleeves (e.g., 37) installed in the corners of the truss. The depth of leg insertion determines the vertical clearance from the surface on which the truss, via its leg carriages, rests and rolls. A plurality of holes (e.g., 61) in the leg provides alternative locations at which a pin 63 can be inserted, so fixing ground clearance.

Referring to FIG. 1C, there is seen a significant gap between the outer diameter of the leg and the inner diameter of the leg-receiving sleeve. Because typical truss sections and their leg carriages are either eight or ten feet long, insertion and removal of leg carriages requires the coordinated actions of two workers, one holding each leg. The relatively large space between leg and sleeve allows a degree of relative mismatch in the motions of the two workers, but also allows them to align and pin holes at different insertion depths, as well as allowing "play" in the connection between the truss and leg carriages, which reduces truss stability and thereby safety, especially when sections are double-stacked.

Figure 1D:
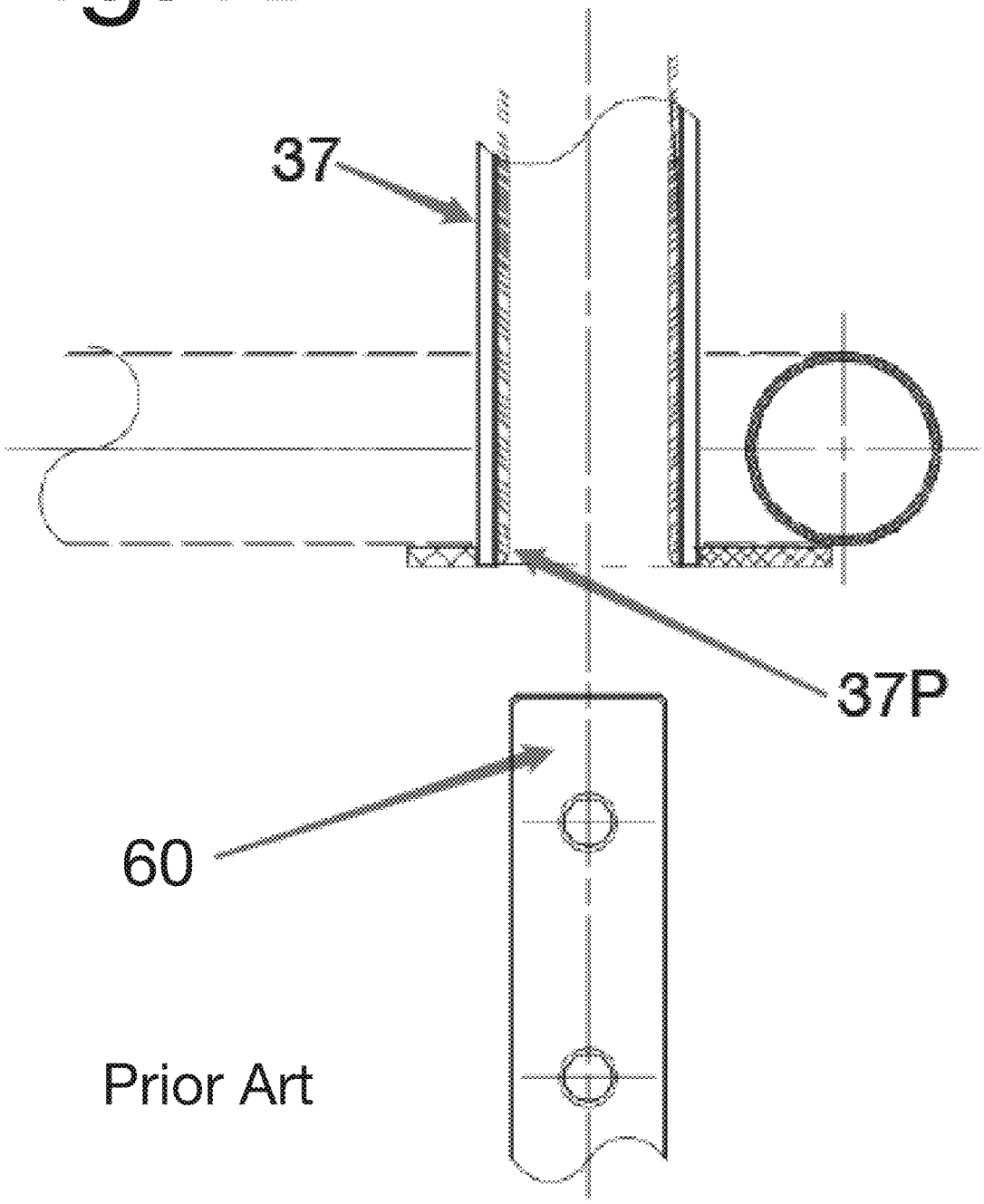
FIG. 1D is a side elevation including a section through the leg-receiving sleeve in a truss section showing the addition of a plastic liner in the sleeve.
Figure 1E:
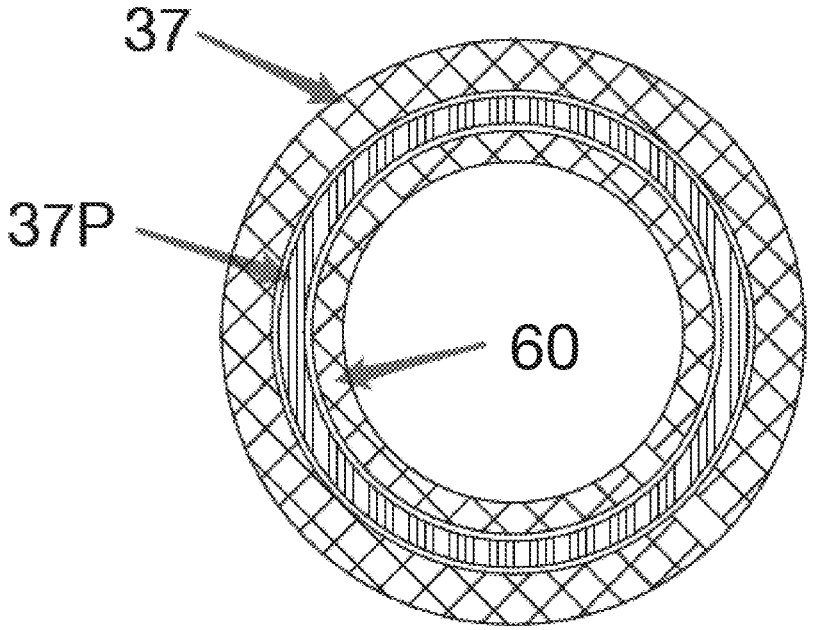
FIG. 1E is a section through a sleeve, leg, and liner.

To reduce such "play", early models of the Tyler leg carriage truss added a plastic liner attached to the interior surface of sleeve 37, seen in FIGS. 1D and 1E as liner 37P, which reduces the clearance and thereby play in the connection. Unfortunately, it also dramatically increases the binding of legs in sleeves when workers at either end of a carriage fail to closely synchronize their motions.

Figure 1F:
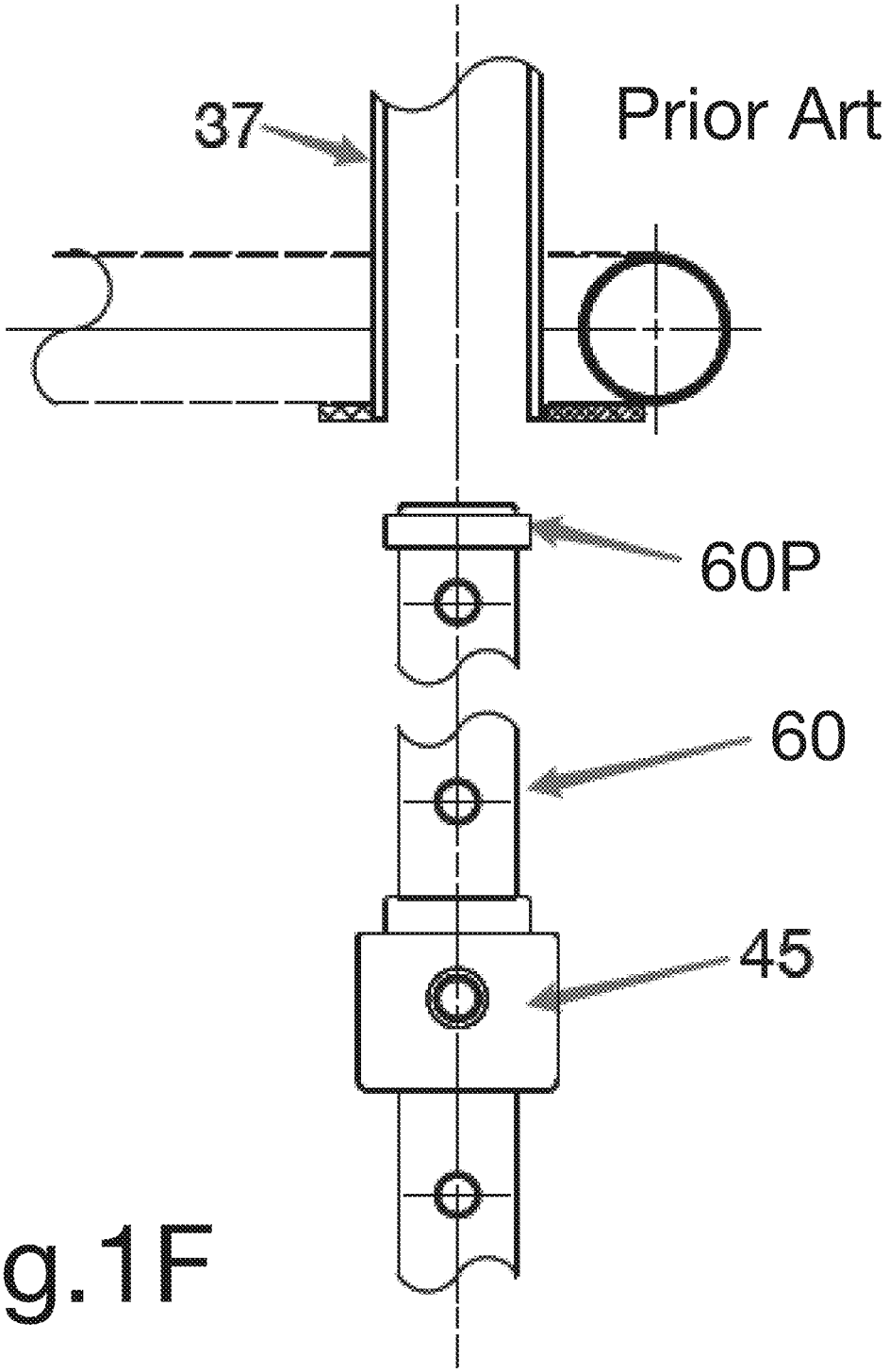
FIG. 1F is a side elevation including a section through a leg-receiving sleeve showing a different prior art approach.

In an effort to address both the problems of unequal leg insertion and of leg binding, Tyler Truss Systems subsequently introduced another approach, seen in FIG. 1F. The liner was omitted from sleeve 37 and a short plastic ring/collar 50P attached at the top of each leg. This allowed more variation between workers' motions. To reduce undesirable lateral "play" in the truss/leg connection, a similar reduction in clearance at the bottom of the sleeve was also necessary. A plastic part 45 was added, sliding along the leg and fixed at a location by a pin inserted through both it and one of the holes 61 in the leg. Shoulder 45S of the part 45, being larger than the diameter of the leg-receiving sleeve 37, serves as a mechanical stop that limits leg insertion to the intended depth. The reduced diameter portion 45A atop part 45, being similar in diameter to collar 50P, provides the required reduced clearance—only if it is fully inserted into the bottom of sleeve 37.

In practice, unless precisely aligned, the top surface of reduced diameter portion 45A can strike the entrance to sleeve 37 without entering it, leading workers to assume that they have inserted the leg too deeply and to pinning it at the next leg hole below in error. When the pin retaining part 45 in place is lost from handling, part 45 slips out of position. The leg is no longer stopped correctly, play is not reduced, and part 45 can be lost off the leg end. A modified leg of FIG. 1F with its collar 50P will not insert in older truss sections having the internal liner 37P of FIG. 1D—but the more recent leg of FIG. 1D will insert in either generation of truss. The liner 37P being hidden within the sleeve, when the two generations of truss are mixed on the same project, mistakes can be made and a residue of leg carriages that will not insert in those truss sections remaining un-legged result.

The root of prior art issues is that ease of leg insertion/removal has been at odds with preventing excessive "play". So long as substantially uniform clearance is provided to the sleeve around the leg, improving one comes at the expense of the other. However, the most relevant tolerance for easier insertion is in the elongated axis of the truss, whereas the tolerance determining lateral play is across it.

Refer now to FIGS. 2A and 2B. In both Figures, the clearances between the leg and the leg-receiving sleeve have been made asymmetrical. In FIG. 2A, leg 50A has been fabricated from an asymmetrical tube such that clearance is relaxed in the long axis of the truss, which allows a significant mismatch in the motions of the workers without resulting in leg binding. Lateral play in the truss section when resting on its leg carriages is reduced by a smaller clearance between the leg and the sleeve in the axis across the truss.

In FIG. 2B, the leg shape is cylindrical, but the sleeve is not. Again, clearance is relaxed in the elongate axis of the leg carriage and truss, reducing jamming, while that laterally is reduced to improve stiffness and stability. Contrary to the approach of FIG. 1F, no additional parts are required on the leg.

FIG. 2C illustrates an embodiment as installed in a truss. The function of a leg-receiving sleeve is provided by an extrusion 37B, which offers asymmetrical clearances. Flanges 37C can be provided in the shape for stiffening, for attachment to the truss chords, and for other purposes. The method by which an asymmetrical configuration is produced should not be understood as limited. For example, multiple braked or milled parts can be assembled.

FIG. 2D illustrates that the benefits of the approach can be achieved using similar shapes for both the leg and sleeve. In the Figure, round tube is used for both and clearance is reduced in one axis by insertion of linear shapes 37S, which might be milled, extruded, or cast, and which can be ramped at the sleeve entry point to enhance insertion. This approach allows use of stock extrusions in truss and leg carriage fabrication as well as retrofit to prior art sections having the un-lined sleeve of FIG. 1F.

FIG. 2E is a side elevation of a typical leg-receiving sleeve installation in a truss section. Leg insertion depth can be limited by means including a mechanical stop inside the leg sleeve, such as provided by additional pass holes 37L in the sleeve and a pin or bolt, as has been illustrated in prior related applications.

Stiffening

The problem of lateral play in leg carriages has been a persistent one and, as a safety precaution, many owners of leg carriage trusses have resorted to the addition of "stiffeners" or "snap braces" spanning between the legs or low horizontal rails (e.g., 54) of leg carriages to reduce it.

Both terms refer to temporary cross-braces attached to two structural members to maintain a fixed distance between them. Long a component of modular tubular scaffolding, they have been employed with trusses for entertainment and events since the 1970s, including with one or both ends made captive.

The requirement for stiffeners to address stability issues with leg carriage trusses adds time and labor to their conversion between shipping and use, because prior art designs must be removed before the leg carriages can be stored and be replaced before truss shipping. They thus present their own handling and storage problems. The applicant has disclosed in prior related applications, various approaches to leg carriage bracing that can remain attached during leg carriage handling and storage.

Refer now to FIGS. 3A-3C.

FIG. 3A is an end elevation of a pair of leg carriages supporting a truss. A "stiffener" 101 attaches to leg 50D of one leg carriage by means of known "snap-latch" 102 mounted at one end, and to leg 50E of the second carriage by means of snap-latch 103 at its other end, in the known manner.

Referring now to FIG. 3B, a plan view, it will be seen that stiffener 101 has been fabricated with a bend 101N at a point along its length.

In FIG. 3C, another plan view, the first leg carriage has been removed from the truss, including by releasing snap-latch 103 from the leg of another carriage. Stiffener 101 has remained attached to leg 50D of the first leg carriage and has been rotated until it is in substantial alignment with the low horizontal rail 54D of the leg carriage. In FIG. 3C it will be seen that the angle in stiffener 101 at 101N conforms it to the shape of low horizontal rail 54D, such that the stiffener no longer presents an obstacle to storing additional leg carriages closely spaced in parallel with the leg carriage to which it remains attached, as would be the case with prior art stiffeners.

Racking Leg Carriages

Such close-packed parallel storage has long been a necessity. The Dodd '913 disclosure suggests that leg carriages, when not in use, can be quickly and easily stored by inverting them and re-inserting their legs into the leg sleeves from above the truss, in so doing forming handrails.

In reality, only a fraction of projects so store, and for many reasons including obstructions above the truss and appearance. Off-truss leg carriage storage, often at locations distant, is frequently necessary. Leg carriages typically require two workers to carry or roll and do not, themselves, stack or store efficiently.

For storage, Tyler Truss Systems, users of its truss, and builders of other leg carriage designs have all built castered dollies, used in pairs, on whose upwardly-projecting studs leg carriages can be racked inverted. Having no purpose when the leg carriages are in use, such dollies, like stiffeners, present their own handling and shipping problems. Prior related applications disclose alternatives in which adaptors attach to a first pair of leg carriages, forming a rolling rack that accepts inverted storage of additional leg carriages at stations along the adaptor's length. When an adaptor is fabricated in the appropriate length it can also serve for the purpose of stiffening the leg carriages while they support a truss section. When pins connecting the leg carriages with the truss section are removed and the truss is lifted, a storage rack for additional leg carriages is left behind, fully assembled.

Maximizing the number of additional leg carriages that can be accommodated by any storage solution is desirable. FIGS. 4A-4D illustrate several techniques applicable to racking.

As will be seen from FIG. 3C, the minimum rack spacing practical has always been limited by the width of the flat plate (e.g., 57C) mounting to the leg both the caster and the plastic cone used in stacking truss sections.

Referring to FIG. 4B, an adaptor 110 will be seen with snap-latches 112 and 113 attaching to legs 50G and 50H of two parallel leg carriages. The adaptor 110 includes provisions, here in the form of projecting studs 114, which engage additional leg carriages, in this example inverted. The adaptor 110 of the Figures is illustrated with collars 115, serving as mechanical stops. Referring to FIG. 4C, it will be seen that the collars 115, by vertically offsetting select additional leg carriages inverted on them, prevent conflict between the caster mounting plates despite reduced centers between the studs. More leg carriages can be accommodated in the same adaptor length.

FIGS. 4D and 4E illustrate another technique. Adaptor 121 has a snap-latch 122 attaching it to leg 50J and snap-latch 123 attaching it to leg 50K. Studs 124 provide stations for supporting additional leg carriages, here in inverted storage. Collars 125 provide for a vertical offset to increase capacity. A stud 126 is offset from attachment 122 and another stud 127 offset from attachment 123, both along the elongated axis of the leg carriage. As seen in FIG. 4E, this allows accommodating two additional inverted leg carriages within the same overall width as the adaptor 111 of the prior Figure.

The embodiments in these and other Figures are illustrative and should not be understood as limited, except by the claims.

Hinging Leg Carriages

The requirement to remove and store leg carriages has always been a substantial drawback of the type. In prior related applications, the applicant disclosed hinged leg carriages to minimize conversion time and effort and render off-truss storage unnecessary. Hinging can be provided for in the design of the truss section or, as the applicant has demonstrated, by adaptors useable with prior art truss sections already in service.

Many methods of fabricating such adaptors are possible. FIGS. 5A-5D illustrate, for example, an extrusion 150 as its basis. Alternating milling operations to the extrusion, as seen in FIGS. 5B and 5C, produces integral hinges and provisions to lock the hinge in both closed and open positions. Sections of tube are attached to the parts. Tube 151 is attached to upper part 150U for engaging the truss by insertion in a leg-receiving sleeve 37 and retention by a pin through pass hole 151H. Tube 152 is attached to lower part 150L to engage the leg of a leg carriage, with retention by a pin through one of pass holes 152H.

Referring to FIG. 5E, a typical range of height/ground clearance adjustment in prior art leg carriage trusses, such as the Dodd/Tyler embodiment, is illustrated. Leg carriage 21A indicates a typical minimum clearance. Leg carriage 21B is an example of a typical high clearance.

In a hinge adaptor, height adjustment range can be limited. Referring to FIG. 5F, with the tube/sleeve 152B engaging leg 50 by telescoping over it, the minimum clearance is determined by the length of tube/sleeve 152 required for proper engagement and by its obstruction by low horizontal rail 54. Because the hinge assembly extends below the truss, its height further impacts the possible range of height adjustment. As illustrated in FIG. 5G, increasing the height of a truss to that of leg carriage 21B as seen in FIG. 5E would result in insufficient overlap/engagement between tube/sleeve 152B and leg 50. A more practical engagement, illustrated in FIG. 5H, results in a marked reduction in maximum height/ground clearance.

Referring, however, to FIGS. 5I-5K it will be seen that if the engagement of the lower part 150L of the hinge assembly is provided by a member extending into the interior of leg 50 (as the member illustrated in FIG. 5D), the obstruction posed by the low horizontal rail is bypassed. The range of height/ground clearance is substantially increased.

Additions

The advantage of "pre-rig" trusses is their reduction in onsite labor. That advantage is eroded by the addition of fixtures and other elements that cannot ship while still attached to the truss. One example is linear LED units used to outline the truss as a graphic element. Another is fixtures attached to the truss that extend beyond its shipping profile. Unless removed before transport, both reduce the number of truss sections that can be accommodated in a truck as well as, being unprotected by the truss structure, subject to damage. Separately shipping and hanging such elements and fixtures on site costs time and labor and can result in highly visible errors in alignment.

The Figures following illustrate methods by which these and other issues can be addressed.

Outlining the truss structure with linear LED strips is often done with products such as the well-known Martin Sceptron-10 modular strip. Such products dispose LED chips along linear printed circuit cards (PCBs) also mounting driver electronics. Such PCBs are inserted in an extruded aluminum housing that protects the components, provides for mounting, and accepts accessory diffusers and lenses.

A difficulty with attaching such products to a truss is that clamps used for the purpose—as well as for attaching fixtures—have no provision to accurately align the units radially with the truss members, which are circular in section.

Referring to FIGS. 6A-6I, approaches are disclosed to providing for illuminated linear accents for truss that minimize onsite labor and offer an attractive appearance.

One such approach employs for low horizontal member 54 of a leg carriage a structural shape that can contain and protect a linear LED assembly while serving the various other functions necessary.

In one embodiment, seen in FIGS. 6A-6F, an extrusion is employed having a generally rectangular cross section with rounded corners. This can provide good interior volume and stiffness while permitting an open slot for light to exit, including via a cover or lens. A flat surface also provides surer contact with the blades of a fork lift, such as are used in stacking truss sections.

The shape can include interior detail that conforms to the round tube stock used in prior art leg carriages. As seen in FIG. 6G, this permits replacing much of the round low rail with the illustrated extrusion, which can be attached at either end with fasteners such as the roll pin in FIG. 6B.

As seen in FIG. 6C, sufficient volume is available within the illustrated extrusion to accommodate permanent mounting of products like the Sceptron-10. The housing provided with such products can be eliminated and the PCB mounted directly to the extrusion 160. The savings in volume by eliminating the prior art housing allows larger PCBs with more area for LEDs. As seen in FIG. 6F, the PCB can be installed at an angle, such that, for example, the beamspread of the LEDs can be aimed for purposes such as audience lighting, as well as being made adjustable.

FIG. 6G illustrates that the incorporation of a linear LED array into the low horizontal rail 54 of a leg carriage produces the desired linear illuminated accent upon inverted storage of the carriage with no additional labor, a very clean appearance, and precise alignment.

FIG. 6H illustrates that a shape 160A can be increased in height to allow additional LEDs/PCB area. FIG. 6I illustrates that a hybrid combination of a structural member 160B and a sheet metal or other type enclosure 160E can provide additional volume, for example, for additional optics and/or actuation of beam angle.

FIGS. 6K-6O illustrate improved mounting methods that may be used with the round stock of existing trusses and other structures. A shape 170, here illustrated as an extrusion aligns on tube 25. It provides a recess in which can be mounted LED/PCB assembly 171, and can provide for a cover or lens 172. As seen in FIG. 6M, the shape 170 can be rotated around tube 25 to the desired radial angle. FIGS. 6N and 6O illustrates one design for a fitting, here comprising two halves 173A and 173B which, by means of bolt 174, clamp shape 170 to the tube. Installed where two sections/lengths of shape 170 join to form a longer span, the fitting assures their alignment.

A Dual Lobe Structural Shape

Referring to FIG. 6J, it will be seen that fixtures and linear LED products hung off plumb from truss chords require that workers must lift and hold the fixture 95 in place while tightening the clamp 96. The same or several workers might not be consistent in the radial angle produced relative to the supporting member. Workers might not tighten the clamp 96 sufficiently to prevent slippage, including due to force applied to the fixture and/or motion of the truss. Because the fixture or other element is in plain view, the effect of variation is unattractive and very difficult to correct once the truss is raised out of reach.

Another issue with "pre-rig" trusses of the leg carriage type is that their reduction in height to allow the fixtures (e.g. 90) largely unobstructed beam angle adjustment reduces the stiffness/load bearing capacity of the structure relative to other types. As such, loads must be limited or spans supported by additional points/chain motors on shorter centers. It would be useful to improve the stiffness/strength of such trusses while maintaining compatibility with at least some of the clamps, hangers, and other attachment hardware in widespread use.

Refer now to FIG. 7A, an example dual lobe structural shape intended to provide higher stiffness with other advantages. One lobe 200A and the other lobe 200B are generally circular in profile and equal in diameter to the round tube stock used in truss construction. Referring to FIG. 7M, it will be seen that a shape such as illustrated can be employed as one or more main chord of truss 20. Such produces a dramatic increase in the load-carrying capacity of the structure for a given overall height. FIG. 7B is an example dual lobe structural shape having an internal volume sufficient to enclose wiring for loads attached to the structure and flat surface area to mount receptacles.

FIG. 7C demonstrates the compatibility of a dual lobe structural shape with prior art "snap-latch" fittings.

FIG. 7D is an example dual lobe shape providing a stiffened slot, which may be used to permit protected, internal mounting of a linear LED assembly, as a curtain track, or as track for unistrut-type mounting of loads.

FIGS. 7E and 7F are example dual lobe structural shapes having internal stiffening.

FIGS. 7G and 7H are example dual lobe structural shapes also providing a recess for internal mounting of a linear LED assembly or for other purposes.

Although most prior art fixture attachment clamps cannot grip the dual lobe shape, they have proven ill suited to the fixture locations at which a dual lobe shape would be employed. Far simpler attachment fittings are practical which are less expensive, save substantial time and labor, and automatically produce a correct radial orientation.

FIG. 7I is a plan view of such a simple fitting 220. FIGS. 7J and 7L are side elevations of the cast or extruded body of the fitting of the prior Figure. FIG. 7K is an end elevation of the fitting of the prior Figures resting on a dual lobe structural shape and including an example thumbscrew 221 which can be used to lock fitting 220 to the structural shape and bolt 222 used to attach a fixture or other load to fitting 220.

FIG. 7M illustrates how a dual lobe shape can provide interior space for integral accent lighting and provide for rapid and accurate on-site attachment of additional fixtures.

Many other designs of and methods for fabricating fittings for attachment to a dual lobe structural shape are possible.

Keyed Round Tube

The dual lobe shape of the prior Figures has many advantages, but it is not compatible with many of the clamps and fittings in current use for attachments to traditional round tube stock, whether as used in truss or "black iron pipe".

FIGS. 8A and 8B illustrate a tube stock compatible with such prior art clamps and fittings, having increased stiffness, and cooperating in assuring correct radial alignment.

FIG. 8A is a section through a round tube shape 26, here an extrusion, including a keyway 26A. FIG. 8B is a section through a round tube shape 27 including a plurality of keyways 27A and 27B. It will be understood that the keyway detail improves the stiffness of the tube without an increase in size, a change in material, or a substantial increase in weight.

FIG. 8C is top view of an example well-known prior art fixture-attaching clamp 230 with the addition of a keying detail. FIG. 8D is a side elevation. FIG. 8E is a section through the subject clamp of the prior Figures showing an example installation of a fastener 231 serving as a key. As seen in FIG. 8F, when used with a tubular shape such as 26 or 27, the clamp 230 cannot be seated or closed until the key 231 is aligned with and enters the keyway 26A. Correct radial alignment is assured.

FIGS. 8G and 8H illustrate another approach to keying. Here, a shape 236, which might be extruded or machined, is received in a corresponding detail in the body of clamp 235 and acts as a key.

In use, portions of a keyway can be filled on a temporary basis to assure that the clamp can only be seated at the correct location. A key can be made removable and/or retractable to permit use with un-keyed tube. A spring or other method can be used to allow a key to retract for un-keyed tube. It will project when the clamp is rotated into correct axial alignment with a key, serving as a detent. More than one feature can be used and with more than one key. In the case of shape 27 it will be understood that a spring plunger could also be mounted in a clamp, such that a key first assures correct radial alignment when it aligns with a first keyway (e.g., 27A), which, in turn, aligns the spring plunger with the second keyway (e.g., 27B). The spring plunger enters the second keyway and locks the clamp on the tube until the spring plunger is manually withdrawn.

Improved Truss Coupling

Trusses require provisions to couple sections to each other to create longer spans. After nearly a half-century, two methods remain in near-universal use.

Most generic truss profiles employ bolted connections between sections. Bolting is time and labor consuming, requiring two wrenches and sixteen parts at each joint. The work is done stooping or kneeling. Unless all bolts are uniformly and sufficiently tightened (which is not visibly confirmable) the truss can be undesirably stressed.

A smaller proportion of trusses employ clevis or "spigoted" fittings joined by steel pins.

FIGS. 9E and 9F illustrate the two methods.

Trusses are generally joined into spans while resting on a floor surface. Aligning pass holes for either pins or bolts is made more difficult when the floor is not level.

In spigoted truss two types of steel pin are in common use. Referring to FIG. 9A, a stubby pin 80 has been provided by many manufacturers. Because of tight pass hole tolerances and misalignment, most pins require driving using a brass or steel mallet of several pounds weight. The tapered nose of the stubby pin 80 has a limited utility in forcing the two fittings into alignment. The more recent type 81, with its longer taper, is more effective. Once driven in, a spring clip 81 (not in relative scale) is inserted into a pass hole 80H or 81H as a safeguard against pin loss.

In disassembling a span, misalignment is typical and pins must be hammered out again. Referring to FIG. 6C, it will be seen that once the tip of stubby pin 80 has been driven flush with the fitting 70, it will remain bound in the fitting unless a second pin or a "drift pin" tool is used to drive it back through the fitting.

FIG. 9D illustrates that the long pin 81, once driven flush, has a reduced diameter within the fitting that will tend to permit removal without binding.

One of the most common generic truss profiles in use is "12×12" (for its nominal cross section). The small profile makes it idea for loads like drapes, scenery, signage, projection screens, cable, and where space is limited. Dozens and even hundreds of such sections can be employed on a production. Its compact cross section and end detail make access to bolts difficult. It would, therefore, be desirable to employ a spigoted/clevis connection for this truss but, as FIG. 9G illustrates, the narrow width of this profile makes the use of a mallet with the long pin impractical.

Refer now to FIGS. 9H through 9O, where an embodiment of a different approach to truss coupling is illustrated.

Two truss sections are illustrated of the 12×12 cross section and typical construction.

One goal of the embodiment is a system retrofitable to existing bolted type sections without modification.

As illustrated, parts 73 and 73A could be fabricated from stock angle. They project from the end of a truss section. Part 75 is essentially a spacer, so that force on the angle is distributed into the rear face of channel 26, which forms the bolting interface in the prior art truss. To assist in aligning truss sections and resist shear, a rounded pin (e.g., 74A) is fixed to spacer 75 and projects through the existing bolt pass hole provided in truss part 26. It will enter the corresponding pass hole in the end of the other truss (e.g., pin 74B through pass hole 26H) and into a recess in its spacer.

Referring to the Figures, it will be seen that the other end of the truss also employs a similar angle and spacer detail (e.g., 75 and 75A), but extending into the interior volume of the section and spaced apart at a distance greater than parts 73 and 73A, such that parts 73 and 73A can be inserted between them, aligning the pass holes (e.g., 73H and 75H).

Driving a pin 77 through the holes completes coupling of the truss sections.

To save time and labor the number of pins is reduced. Here, one is illustrated. Pin 77 is fabricated with a series of different diameters. Pass holes 73H and 75H in one pair of angles 73 and 75 are slightly larger than those in angles 73A and 75A. Portion 77C is a fit for pass holes 73H and 75H. Portion 77D is a fit for the smaller pass holes in parts 73A and 75A.

As shown in FIG. 9L, inserting the tapered end of 77E of pin 77 into holes 73H and 75H and then into 73AH and 75AH begins alignment of the coupling.

As shown in FIG. 9N, further insertion, including by mallet-driving head 77A, pushes the next larger diameter portions of pin 77 into the pass holes, further aligning the parts.

When the pin 77 is fully driven in, the appropriate portions of the pin close tolerances and clamp the two trusses tightly together.

Both the head 77A and tip 77E of the pin are generally within the envelope of the truss. Tip 77E is accessible for driving out for removal.

As in all prior Figures, the embodiments illustrated are illustrative of the principles and other embodiments should not be understood as limited except by the claims.

A multi-stage locking pin can be employed with other couplers.

The embodiment illustrated is intended to be retrofitable to the generic truss designs already in the field without modification. In new construction, the parts and features could be integrated into the design of the truss end.

What is claimed is:

1. A truss section, said truss section being elongated and having two ends, each of said ends suitable for mechanically coupling said truss section with another one of said truss sections, said truss section having an elongated central axis extending between said ends, and having first and second sides substantially parallel with one another, said first side comprising:

a first elongated chord, said first chord extending between said ends, said first chord being substantially parallel to said elongated central axis, a second elongated chord, said second chord extending between said ends, said second chord being substantially parallel to and spaced apart from said first chord, first cross-members mechanically connecting said first chord with said second chord, said second side comprising:

a third elongated chord, said third chord extending between said ends, said third chord being substantially parallel to and spaced apart from said first and said second chords, a fourth elongated chord, said fourth chord extending between said ends, said fourth chord being substantially parallel to and spaced apart from said first chord, said second chord, and said third chord, second cross-members mechanically connecting said third chord with said fourth chord, the intersections of said first and said second sides with said ends defining four corners of said section, said truss further comprising:

third cross-members mechanically connecting said first side and said second side, first and second leg carriages, said leg carriages being separable from said truss and from each other, said leg carriages each having at least a first and a second elongated leg, said first and said second leg having a cross sectional shape, said first and said second elongated leg each having one and another end and an elongated axis extending between said one and another ends of said leg, said leg carriages each having an additional elongated structural member having first and second ends, and being attached at said first end to said first leg proximate to said one end of said first leg, and being attached at said second end to said second leg proximate to said one end of said second leg, each of said leg carriages having at least two casters, one of said casters being attached proximate to said one end of each of said legs, at least four sleeves, each of said sleeves attached to said truss and each having an elongated axis and a cross sectional shape, one of said sleeves in each of said corners, said elongated axis of each of said sleeves parallel to said sides and to each other, each of said sleeves dimensioned to accept insertion of said another end of one of said elongated legs along said elongated axis of said sleeve, said sleeve and said leg having cross sectional shapes, said cross sectional shapes of said sleeve and said leg when said leg is inserted in said sleeve: (i) defining two clearances between said leg and said sleeve on a first axis, said first axis bisected by said elongated axis of said sleeve and parallel to said elongated central axis of said truss section, and (ii) defining two clearances between said leg and said sleeve on a second axis, said second axis bisected by said elongated axis of said sleeve and perpendicular to said elongated central axis of said truss and to said elongated axis of said sleeve, a total of said two clearances on the first axis being greater than a total of the two clearances on the second axis.

2. A truss section according to claim 1, wherein the inner surface of said cross section of said sleeve defines a circle.

3. A truss section according to claim 1, wherein the outer surface of said cross section of said leg defines a circle.

4. A truss section according to claim 1, wherein the inner surface of said cross section of said sleeve defines a rectangle.

5. A truss section according to claim 1, and further including at least one additional component for reducing the clearance in said second axis that is perpendicular to said elongated central axis of said truss and to said elongated axis of said leg.

6. A truss section, said truss section being elongated and having two ends, each of said ends suitable for mechanically coupling said truss section with another one of said truss sections, said truss section having an elongated central axis extending between said ends, and having first and second sides substantially parallel with one another, said first side comprising:

a first elongated chord, said first chord extending between said ends, said first chord being substantially parallel to said elongated central axis, a second elongated chord, said second chord extending between said ends, said second chord being substantially parallel to and spaced apart from said first chord, first cross-members mechanically connecting said first chord with said second chord, said second side comprising:

a third elongated chord, said third chord extending between said ends, said third chord being substantially parallel to and spaced apart from said first and said second chords, a fourth elongated chord, said fourth chord extending between said ends, said fourth chord being substantially parallel to and spaced apart from said first chord, said second chord, and said third chord, second cross-members mechanically connecting said third chord with said fourth chord, said truss further comprising:

third cross-members mechanically connecting said first side and said second side, first and second leg carriages, said leg carriages being separable from said truss and from each other, said leg carriages each having at least a first and a second elongated leg, said first and said second elongated leg each having one and another end and an elongated axis extending between said one and another ends of said leg, said leg carriages each having an additional elongated structural member having first and second ends, and being attached at said first end to said first leg proximate to said one end of said first leg, and being attached at said second end to said second leg proximate to said one end of said second leg, each of said leg carriages having at least two casters, one of said casters being attached proximate to said one end of each of said legs, at least four sleeves, each of said sleeves attached to said truss proximate to a said end of said truss, each having an elongated axis, said elongated axis of each of said sleeves parallel with each other, each of said sleeves dimensioned to accept insertion of said another end of one of said elongated legs along said elongated axis of said sleeve, wherein insertion of said leg in said sleeve defining first and second tolerances between said leg and said sleeve in an axis that is parallel to said elongated central axis of said truss section and third and fourth tolerances between said leg and said sleeve in an axis that is perpendicular to said elongated central axis of said truss and to said elongated axis of said sleeve, the sum of said first and second tolerances being greater than the sum of said third and fourth tolerances.

7. A truss section according to claim 6, wherein the inner surface of said cross section of said sleeve defines a circle.

8. A truss section according to claim 6, wherein the outer surface of said cross section of said leg defines a circle.

9. A truss section according to claim 6, wherein the inner surface of said cross section of said sleeve defines a rectangle.

10. A truss section according to claim 6, and further including at least one additional component for reducing the clearance in said second axis that is perpendicular to said elongated central axis of said truss and to said elongated axis of said leg.

11. Apparatus for supporting a truss section, comprising first and second leg carriages, said leg carriages being separable from said truss and from each other, said leg carriages each having at least a first and a second elongated leg, said first and said second leg having a cross sectional shape, said first and said second elongated leg each having one and another end and an elongated axis extending between said one and another ends of said leg, said leg carriages each having an additional elongated structural member having first and second ends, and being attached at said first end to said first leg proximate to said one end of said first leg, and being attached at said second end to said second leg proximate to said one end of said second leg, each of said leg carriages having at least two casters, one of said casters being attached proximate to said one end of each of said legs, said truss section being elongated and having two ends, each of said ends suitable for mechanically coupling said truss section with another one of said truss sections, said truss section having an elongated central axis extending between said ends, and having first and second sides substantially parallel with one another, said first side comprising:

a first elongated chord, said first chord extending between said ends, said first chord being substantially parallel to said elongated central axis, a second elongated chord, said second chord extending between said ends, said second chord being substantially parallel to and spaced apart from said first chord, first cross-members mechanically connecting said first chord with said second chord, said second side comprising:

a third elongated chord, said third chord extending between said ends, said third chord being substantially parallel to and spaced apart from said first and said second chords, a fourth elongated chord, said fourth chord extending between said ends, said fourth chord being substantially parallel to and spaced apart from said first chord, said second chord, and said third chord, second cross-members mechanically connecting said third chord with said fourth chord, said truss section further comprising:

third cross-members mechanically connecting said first side and said second side, at least four sleeves, each of said sleeves attached to said truss section proximate to a said end of said truss, each of said sleeves having an elongated axis and a cross sectional shape, said elongated axis of each of said sleeves parallel with each other, each of said sleeves dimensioned to accept insertion of said another end of one of said elongated legs of said leg carriage along said elongated axis of said sleeve, said sleeve and said leg having different cross sectional shapes, said cross sectional shapes of said sleeve and said leg when said leg is inserted in said sleeve: (i) defining two clearances between said leg and said sleeve on a first axis, said first axis bisected by said elongated axis of said sleeve and parallel to said elongated central axis of said truss section, and (ii) defining two clearances between said leg and said sleeve on a second axis, said second axis bisected by said elongated axis of said sleeve and perpendicular to said elongated central axis of said truss and to said elongated axis of said sleeve, a total of said two clearances on the first axis being greater than a total of the two clearances on the second axis.

12. Apparatus according to claim 11, wherein the inner surface of said cross section of said sleeve defines a circle.

13. Apparatus according to claim 11, wherein the outer surface of said cross section of said leg defines a circle.

14. Apparatus according to claim 11, wherein the inner surface of said cross section of said sleeve defines a rectangle.

15. Apparatus according to claim 11, and further including at least one additional component for reducing the clearance in said second axis that is perpendicular to said elongated central axis of said truss and to said elongated axis of said leg.

* * * * *